US010308451B2

(12) United States Patent
Kikuta

(10) Patent No.: US 10,308,451 B2
(45) Date of Patent: Jun. 4, 2019

(54) SHEET FEEDING DEVICE, IMAGE FORMING APPARATUS, AND METHOD FOR CONTROLLING SHEET FEEDING DEVICE

(71) Applicant: KYOCERA Document Solutions Inc., Osaka (JP)

(72) Inventor: Tomoyuki Kikuta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/057,007

(22) Filed: Aug. 7, 2018

(65) Prior Publication Data

US 2019/0062079 A1 Feb. 28, 2019

(30) Foreign Application Priority Data

Aug. 24, 2017 (JP) ..... 2017-160900

(51) Int. Cl.

| | |
|---|---|
| ***B65H 1/18*** | (2006.01) |
| ***B65H 1/04*** | (2006.01) |
| ***B65H 1/26*** | (2006.01) |
| ***B65H 1/14*** | (2006.01) |
| ***B65H 7/02*** | (2006.01) |

(52) U.S. Cl.

CPC ..... *B65H 1/18* (2013.01); *B65H 1/04* (2013.01); *B65H 1/14* (2013.01); *B65H 1/266* (2013.01); *B65H 7/02* (2013.01); *B65H 2511/10* (2013.01); *B65H 2511/12* (2013.01); *B65H 2511/152* (2013.01); *B65H 2511/20* (2013.01); *B65H 2511/30* (2013.01); *B65H 2511/51* (2013.01); *B65H 2553/23* (2013.01)

(58) Field of Classification Search

CPC ... B65H 1/08; B65H 1/14; B65H 1/18; B65H 1/266; B65H 7/00; B65H 7/02; B65H 7/04; B65H 7/14; B65H 7/20; B65H 1/00; B65H 1/04; B65H 2511/12; B65H 2511/152; B65H 2511/51

See application file for complete search history.

(56) References Cited

U.S. PATENT DOCUMENTS 5,572,630 A * 11/1996 Azuma ..... B41J 13/0018 358/1.12
2014/0203496 A1* 7/2014 Hamasaki ..... B65H 1/266 271/18

(Continued)

FOREIGN PATENT DOCUMENTS

JP 7-61646 A 3/1995

*Primary Examiner* — Prasad V Gokhale
(74) *Attorney, Agent, or Firm* — Stein IP, LLC

(57) ABSTRACT

A sheet feeding device includes a cassette and a first sensor unit. The first sensor unit includes a first conductive plate and a first coil circuit board, so as to output a first output value corresponding to a position of the first conductive plate. A first moving mechanism moves the first conductive plate according to remaining quantity of paper sheets. The first conductive plate is attached to the cassette. The first coil circuit board is not attached to the cassette. A control unit determines current remaining quantity of paper sheets based on a magnitude of the first output value. The control unit determines whether or not the cassette is attached based on the magnitude of the first output value and a reference value.

11 Claims, 14 Drawing Sheets

(56) References Cited

U.S. PATENT DOCUMENTS

| | | | | |
|---|---|---|---|---|
| 2015/0183596 | A1* | 7/2015 | Shimazu | B65H 1/14 271/153 |
| 2017/0087883 | A1* | 3/2017 | Matsui | B41J 29/46 |
| 2017/0341889 | A1* | 11/2017 | Kikuta | G03G 15/6511 |
| 2018/0282084 | A1* | 10/2018 | Inoue | B65H 1/18 |

* cited by examiner

| | FIRST OUTPUT VALUE ~A1 |
|---|---|
| FULL SHEET VALUE | B1 |
| NO SHEET VALUE | B2 |

※B1= A EXAMPLE OF FULL SHEET VALUE
※B2= A EXAMPLE OF NO SHEET VALUE

FIG.19

D1

| SECOND OUTPUT VALUE | SIZE(mm) |
|---|---|
| ... | ... |
| X1≦X<X2 | Z1 |
| X2≦X<X3 | Z2 |
| X3≦X<X4 | Z3 |
| X4≦X<X5 | Z4 |
| ... | ... |

※X=SECOND OUTPUT VALUE

FIG.20

D2

| THIRD OUTPUT VALUE | SIZE(mm) |
|---|---|
| ... | ... |
| Y1≦Y<Y2 | Z5 |
| Y2≦Y<Y3 | Z6 |
| Y3≦Y<Y4 | Z7 |
| Y4≦Y<Y5 | Z8 |
| ... | ... |

※Y=THIRD OUTPUT VALUE

SHEET FEEDING DEVICE, IMAGE FORMING APPARATUS, AND METHOD FOR CONTROLLING SHEET FEEDING DEVICE

INCORPORATION BY REFERENCE

This application is based upon and claims the benefit of priority from the corresponding Japanese Patent Application No. 2017-160900 filed Aug. 24, 2017, the entire contents of which are hereby incorporated by reference.

BACKGROUND

The present disclosure relates to a sheet feeding device that feeds paper sheets. In addition, the present disclosure relates to an image forming apparatus including the sheet feeding device. In addition, the present disclosure relates to a method for controlling the sheet feeding device.

There are image forming apparatuses such as a multifunction peripheral, a copier, a printer, and a facsimile machine. The image forming apparatus stores paper sheets. For example, paper sheets are housed in a sheet cassette. When performing printing, the paper sheets are fed. The image forming apparatus (sheet feeding device) may perform detection about the paper sheets. There is a known example of a device that detects remaining quantity of paper sheets by using a sensor described below.

Specifically, there is a known sheet feed control device, which makes pressure contact with the top surface of paper sheets stacked on a sheet placing plate so as to feed a paper sheet, identifies stack quantity of paper sheets based on an induced voltage generated by an induction coil when the induction coil and electromagnetic field generation means are disposed at corresponding positions and one of them is disposed to move according to movement of the sheet placing plate, and determines presence or absence of a sheet feed cassette based on a detection signal output from a cassette detection unit.

The image forming apparatus includes the sheet feeding device. The sheet feeding device may include a sheet cassette. A bundle of paper sheets is set in the sheet cassette. To replenish or change paper sheets, the sheet cassette is detachable and attachable. When paper sheets run out, the sheet cassette is pulled out from the image forming apparatus. After paper sheets are replenished, the sheet cassette is inserted into the image forming apparatus.

During a period while the sheet cassette is detached, paper sheets cannot be fed. In other words, during a period while the sheet cassette is not attached, printing cannot be performed. Accordingly, a sensor for detecting whether or not the sheet cassette is attached is usually provided. In addition, if the sheet cassette is insufficiently inserted, sheet jamming may occur. Therefore, a contact-type switch is used as a sensor for detecting an attached or detached state. For example, a part of the contact-type switch contacts with a case of the sheet cassette. Using the contact-type sensor, it can be checked whether or not the sheet cassette is sufficiently inserted.

In addition, the sheet feeding device is equipped with a plurality of sensors other than the attachment/detachment detection sensor. For example, a sensor for detecting a sheet size and a sensor for detecting remaining quantity of paper sheets are disposed. As these sensors, a sensor including an actuator, and a plurality of optical sensors are used. One or more sensors are used for one detection item. There is a problem that an increase in the number of sensors causes an increase in development time and effort and in production cost.

In the known technique described above, one or more sensors are used for detecting remaining quantity of paper sheets. In addition, a cassette detection unit for detecting presence or absence of the sheet feed cassette is disposed separately. There is no description about a try to reduce the number of sensors, and hence the problem described above cannot be solved.

SUMMARY

A sheet feeding device according to the present disclosure includes a cassette, a first sensor unit, a first moving mechanism, a storage unit, and a control unit. The cassette includes a sheet placing plate having an upper surface on which paper sheets are set. The cassette is detachable and attachable. The first sensor unit includes a first conductive plate and a first coil circuit board on which a coil pattern is printed. The first coil circuit board is applied with a voltage so that a magnetic field is generated. The first sensor unit outputs a first output value corresponding to a position of the first conductive plate. The first moving mechanism moves the first conductive plate so that a facing area between the first conductive plate and the first coil circuit board is increased or decreased according to remaining quantity of paper sheets in the cassette. The storage unit stores remaining quantity detection data for determining current remaining quantity of paper sheets corresponding to the first output value. The storage unit stores a reference value for determining whether or not the cassette is attached. The control unit recognizes a magnitude of the first output value. The first conductive plate is attached to the cassette. The first coil circuit board is not attached to the cassette but is disposed at a position facing the first conductive plate in a non-contact manner when the cassette is attached. The control unit determines the current remaining quantity of paper sheets based on the magnitude of the first output value and the remaining quantity detection data. The control unit determines whether or not the cassette is attached based on the magnitude of the first output value and the reference value.

Further features and advantages of the present disclosure will become apparent from the description of embodiments given below.

BRIEF DESCRIPTION OF THE DRAWINGS

FIG. 19 is a table showing one example of first sheet size data according to the embodiment.

FIG. 20 is a table showing one example of second sheet size data according to the embodiment.

DETAILED DESCRIPTION

The present disclosure is aimed at enabling a sensor for detecting remaining quantity of paper sheets to also detect whether or not a cassette is attached. An embodiment of the present disclosure is described below with reference to FIGS. 1 to 20. Further, the following description exemplifies a multifunction peripheral 100 (corresponding to an image forming apparatus) including a sheet feeding device 1. However, elements such as structures and layouts described in the embodiment are merely examples for description and should not be interpreted to limit the scope of the disclosure.

(Outline of Image Forming Apparatus)

Figure 1:
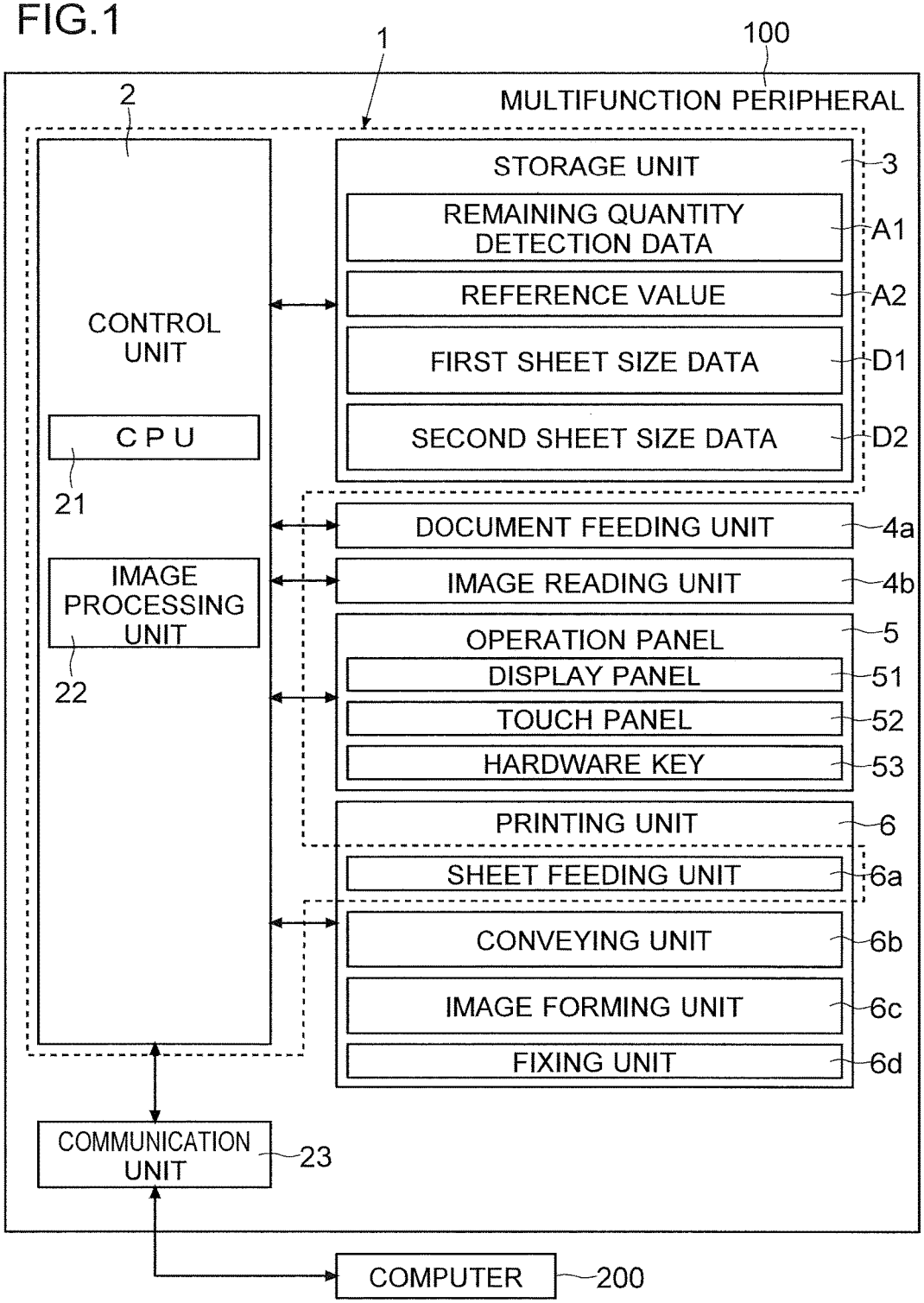
FIG. 1 is a diagram illustrating one example of a multifunction peripheral according to an embodiment.

First, with reference to FIG. 1, the multifunction peripheral 100 according to the embodiment is described. The multifunction peripheral 100 includes a control unit 2 and a storage unit 3. The control unit 2 integrally controls operation of the entire apparatus. The control unit 2 controls individual units of the multifunction peripheral 100. The control unit 2 includes a CPU 21 and an image processing unit 22. The CPU 21 performs calculation and control. The image processing unit 22 performs image processing necessary for printing on image data. The storage unit 3 includes storage devices such as a ROM, a RAM, and an HDD. The storage unit 3 stores control programs and data.

The control unit 2 is connected to a document feeding unit 4*a* and an image reading unit 4*b* in a communicable manner. The document feeding unit 4*a* feeds a set document (sheet) to a reading position. The image reading unit 4*b* reads the document fed by the document feeding unit 4*a* or a document set on a document table (or contact glass, not shown). The image reading unit 4*b* generates image data of the document. The control unit 2 controls operations of the document feeding unit 4*a* and the image reading unit 4*b*.

The control unit 2 is connected to an operation panel 5 in a communicable manner. The operation panel 5 includes a display panel 51, a touch panel 52, and a hardware key 53. For example, the hardware key 53 is a start key. The control unit 2 controls display of the display panel 51. The control unit 2 controls the display panel 51 to display information. The information to be displayed is, for example, a setting screen, a status of the multifunction peripheral 100, or a message. The control unit 2 controls the display panel 51 to display an operation image. The operation image is a software key or button. On the basis of an output of the touch panel 52, the control unit 2 recognizes an operated operation image. In addition, the control unit 2 recognizes the hardware key 53 operated. The control unit 2 controls the display panel 51 to switch to a screen corresponding to the operated operation image or hardware key 53. In addition, the control unit 2 controls the multifunction peripheral 100 to operate according to setting with the operation panel 5.

The multifunction peripheral 100 includes a printing unit 6. The printing unit 6 includes a sheet feeding unit 6*a*, a conveying unit 6*b*, an image forming unit 6*c*, and a fixing unit 6*d*. The control unit 2 controls the printing unit 6. The printing unit 6 performs sheet feeding, sheet conveying, toner image forming, transferring, and fixing. In other words, the control unit 2 controls operations of the sheet feeding unit 6*a*, the conveying unit 6*b*, the image forming unit 6*c*, and the fixing unit 6*d*. Specifically, the control unit 2 controls the sheet feeding unit 6*a* to feed paper sheets one by one. The control unit 2 controls the conveying unit 6*b* to convey the fed paper sheet to a discharge tray (not shown) via the image forming unit 6*c* and the fixing unit 6*d*. The control unit 2 controls the image forming unit 6*c* to form a toner image to be on the paper sheet conveyed by the conveying unit 6*b*. The control unit 2 controls to transfer the toner image onto the paper sheet. The control unit 2 controls the fixing unit 6*d* to fix the toner image transferred onto the paper sheet.

The multifunction peripheral 100 includes a communication unit 23. The communication unit 23 is an interface for communication. The communication unit 23 communicates with a computer 200. The computer 200 is a PC or a server, for example. The communication unit 23 communicates with the computer 200 via a network. The communication unit 23 receives print data from the computer 200. The print data contains image data or the like indicating print content and print setting data. The control unit 2 controls the printing unit 6 to perform printing based on the print data.

(Sheet Feeding Unit 6*a*)

Figure 2:
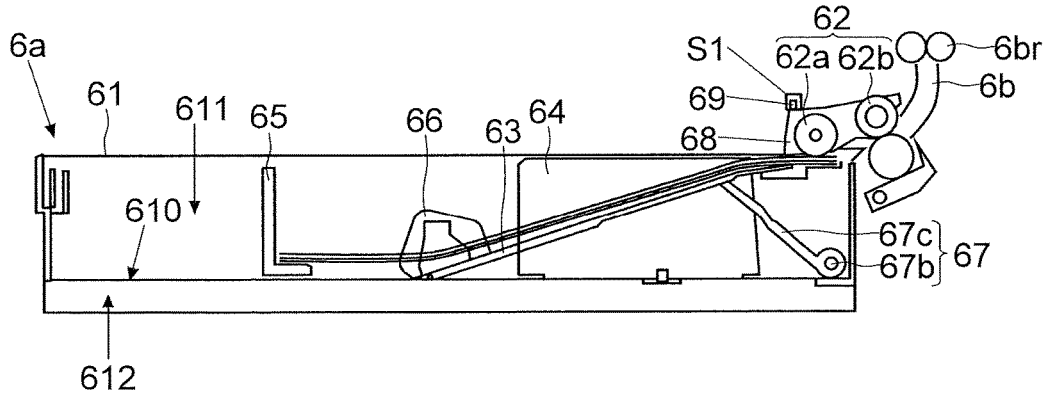
FIG. 2 is a diagram illustrating one example of a sheet feeding unit according to the embodiment.

Next, with reference to FIG. 2, the sheet feeding unit 6*a* according to the embodiment is described. The sheet feeding unit 6*a* stores a plurality of paper sheets. The sheet feeding unit 6*a* sends out paper sheets one by one. The sheet feeding unit 6*a* includes a cassette 61 and a sheet feeding mechanism 62. The cassette 61 can be pulled out from the multifunction peripheral 100. After the cassette 61 pulled out, paper sheets can be replenished or paper sheets can be changed.

The cassette 61 includes a sheet placing plate 63, a width regulation cursor pair 64 (only one of cursors is shown in FIG. 2), and a rear end regulation cursor 65. Paper sheets (bundle of paper sheets) are set on the sheet placing plate 63. A supporting part 66 supports an upstream end (left end in FIG. 2) of the sheet placing plate 63 in a rotatable manner. The sheet placing plate 63 is rotatable in an up and down direction. A downstream end (right end in FIG. 2) of the sheet placing plate 63 is a free end.

A lifting mechanism 67 is disposed below the downstream end of the sheet placing plate 63. The lifting mechanism 67 moves the sheet placing plate 63 upward. The lifting mechanism 67 includes a lifting motor 67*a* (see FIG. 3), a drive shaft 67*b*, and a lifting member 67*c*. The lifting member 67*c* has a plate-like shape. The lifting member 67*c* is secured to the drive shaft 67*b*. The drive shaft 67*b* rotated by drive of the lifting motor 67*a*. When rotating the lifting member 67*c*, the control unit 2 controls the lifting motor 67*a* to operate. As a result, the drive shaft 67*b* rotates, and the tip end of the lifting member 67*c* move upward. When the lifting member 67*c* is rotated, the downstream end of the sheet placing plate 63 is lifted upward.

The width regulation cursor pair 64 can be moved to slide in a direction perpendicular to the conveying direction. Width regulation cursors 64*a* of the width regulation cursor pair 64 move together with each other. The width regulation cursors 64*a* contact with the set paper sheets so that the position of the paper sheets is regulated. The rear end regulation cursor 65 can be moved to slide in the conveying direction. The rear end regulation cursor 65 contacts with the set paper sheets. The rear end regulation cursor 65 regulates a rear end position of the paper sheets.

The sheet feeding mechanism 62 includes a sheet feed roller 62*a* and a handling roller pair 62*b*. The sheet feed roller 62*a* is disposed above the downstream end of the sheet placing plate 63. The handling roller pair 62*b* is disposed on the downstream side of the sheet feed roller 62*a* in the conveying direction. The handling roller pair 62*b* prevents double feeding of paper sheets. The upper roller of the handling roller pair 62*b* rotates to feed a paper sheet in the forward direction. The lower roller rotates to feed a paper sheet in the reverse direction (toward the cassette).

(Sheet Feeding Device 1)

Figure 3:
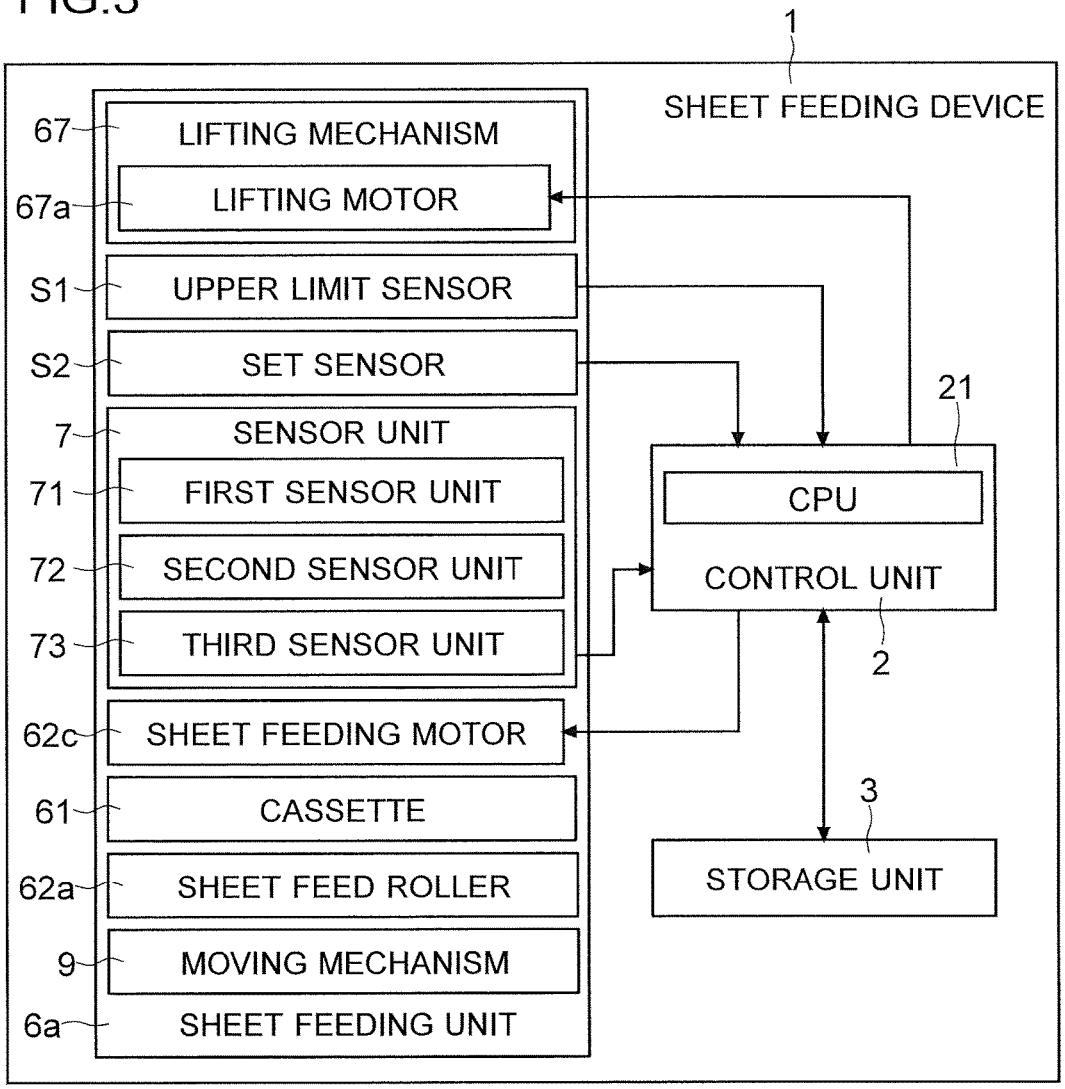
FIG. 3 is a diagram illustrating one example of a sheet feeding device according to the embodiment.
Figure 4:
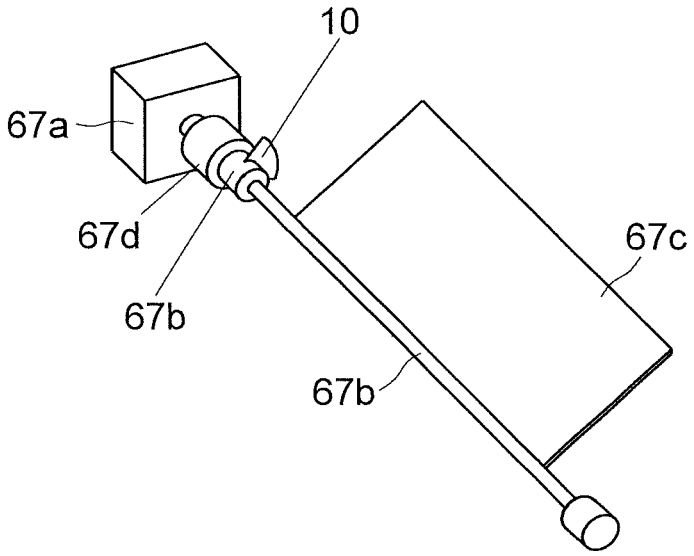
FIG. 4 is a diagram illustrating one example of a lifting mechanism according to the embodiment.

With reference to FIGS. 2 to 4, the sheet feeding device 1 according to the embodiment is described. The sheet feeding device 1 includes the sheet feeding unit 6*a*, the control unit 2, and the storage unit 3. The control unit 2 is also a unit that controls the sheet feeding device 1. The storage unit 3 is also a unit that stores data related to the sheet feeding device 1.

The sheet feeding unit 6*a* includes the cassette 61, the sheet feed roller 62*a*, the lifting mechanism 67, a sensor unit 7, and a moving mechanism 9. The sensor unit 7 includes a first sensor unit 71, a second sensor unit 72, and a third sensor unit 73. The first sensor unit 71 is a unit for detecting remaining quantity of paper sheets set in the cassette 61 (sheet placing plate 63). In addition, the first sensor unit 71 is also a unit for determining whether or not the cassette 61 is attached. The second sensor unit 72 and the third sensor unit 73 are units for detecting a size of paper sheets set in the sheet feeding unit 6*a* (cassette 61). Details of the sensor unit 7 are described later.

The rotation shaft of the sheet feed roller 62*a* is supported by a shaft support member 68. The shaft support member 68 is put on the rotation shaft of the handling roller pair 62*b*. With the shaft support member 68, the sheet feed roller 62*a* swings in the up and down direction. Along with moving up and down of the sheet feed roller 62*a*, the shaft support member 68 swings in the up and down direction. An upper limit sensor S1 is provided to the sheet feeding device 1. The upper limit sensor S1 detects that the sheet feed roller 62*a* has reached a predetermined upper limit by movement of the sheet placing plate 63.

When the downstream end of the sheet placing plate 63 moves upward, the sheet feed roller 62*a* contacts with the upper most paper sheet. When the sheet placing plate 63 is further moved upward, a position of the sheet feed roller 62*a* is also raised. The sheet placing plate 63 raises the sheet feed roller 62*a*. The upper limit sensor S1 detects that the sheet feed roller 62*a* has reached the upper limit position. Therefore, when the sheet feed roller 62*a* is at the upper limit position, the sheet placing plate 63 is also at the upper limit. The upper limit position changes depending on thickness of the bundle of paper sheets set currently.

The upper limit sensor S1 is, for example, a transmission type optical sensor. The upper limit sensor S1 changes its signal output level (high level or low level) depending on whether or not the sheet feed roller 62*a* is at the upper limit position. The sheet feed roller 62*a* or the shaft support member 68 is provided with a protrusion 69. When the sheet feed roller 62*a* reaches the upper limit position, the protrusion 69 blocks an optical path between a light emitting part and a light receiving part of the upper limit sensor S1 (optical sensor). The control unit 2 recognized that the sheet feed roller 62*a* has reached the upper limit based on the output of the upper limit sensor 51. When recognizing the reaching to the upper limit, the control unit 2 stops the lifting motor 67*a*.

With reference to FIG. 4, the lifting mechanism 67 is described. The lifting motor 67*a* is disposed outside the cassette 61 (on the main body side). The longitudinal direction of the drive shaft 67*b* is perpendicular to the paper sheet conveying direction. The drive shaft 67*b* is coupled to the lifting motor 67*a* via a coupling part 67*d*. The coupling part 67*d* is disposed on a drive transmission path. The control unit 2 controls the lifting motor 67*a* to operate. In this case, the lifting motor 67*a* rotates the drive shaft 67*b* (lifting member 67*c*) in a direction where the sheet placing plate 63 moves upward.

When the cassette 61 is pulled out frontward, the coupling part 67*d* is separated. In this way, coupling between the lifting motor 67*a* and the drive shaft 67*b* is released. In other words, coupling between the coupling part 67*d* and the drive shaft 67*b* is released. As a result, the drive transmission path is disconnected. When the cassette 61 is detached (coupling is released), the sheet placing plate 63 is automatically moved downward by gravity action. The lifting mechanism 67 utilizes the gravity action to move the sheet placing plate 63 downward. Finally, the sheet placing plate 63 moves down to a lower limit position. The lifting mechanism 67 moves the sheet placing plate 63 and the lifting member 67*c* downward to the lower limit position. The sheet placing plate 63 and the lifting member 67*c* fall flat.

In addition, when the cassette 61 is securely and fully inserted, the drive shaft 67*b* is inserted into the coupling part 67*d*. The coupling part 67*d* makes coupling between the lifting motor 67*a* and the drive shaft 67*b*. On the basis of an output value (first output value V1) of the first sensor unit 71, the control unit 2 recognizes that the cassette 61 has been attached. After this recognition, or when starting sheet feeding, the control unit 2 controls the lifting motor 67*a* to operate. The control unit 2 controls the sheet feed roller 62*a* and the sheet placing plate 63 to move to the upper limit position. Note that the control unit 2 controls the lifting motor 67*a* to briefly rotate every feeding of one or more paper sheets. When the paper sheets are consumed so that the sheet feed roller 62*a* moves down a little, the sheet feed roller 62*a* is moved again up to the upper limit position.

When sending out the paper sheet, the control unit 2 controls a sheet feeding motor 62*c* to rotate. In this way, the sheet feed roller 62*a* and the handling roller pair 62*b* rotate. The sheet feed roller 62*a* and the handling roller pair 62*b* send the paper sheet to the downstream. The conveying unit 6*b* is provided with a plurality of conveying roller pairs 6*br*. The conveying roller pairs 6*br* convey the paper sheet (see FIG. 2). FIG. 2 shows only one conveying roller pair 6*br* for convenience sake. When performing continuous printing on a plurality of paper sheets, the control unit 2 controls the sheet feed roller 62*a* to repeat rotation and temporary stop so that a constant interval between paper sheets is secured.

In addition, the sheet feeding unit 6*a* is provided with a set sensor S2. The set sensor S2 is a sensor for detecting whether or not paper sheets are set (for example, optical sensor). An output level of the set sensor S2 when paper sheets are set is different from that when paper sheets are not set (high level or low level). On the basis of the output of the set sensor S2, the control unit 2 can detect whether or not paper sheets are set in the cassette 61. When there is no paper sheet, the control unit 2 controls the display panel 51 to display run out of paper sheets.

(Sensor Unit 7)

Figure 5:
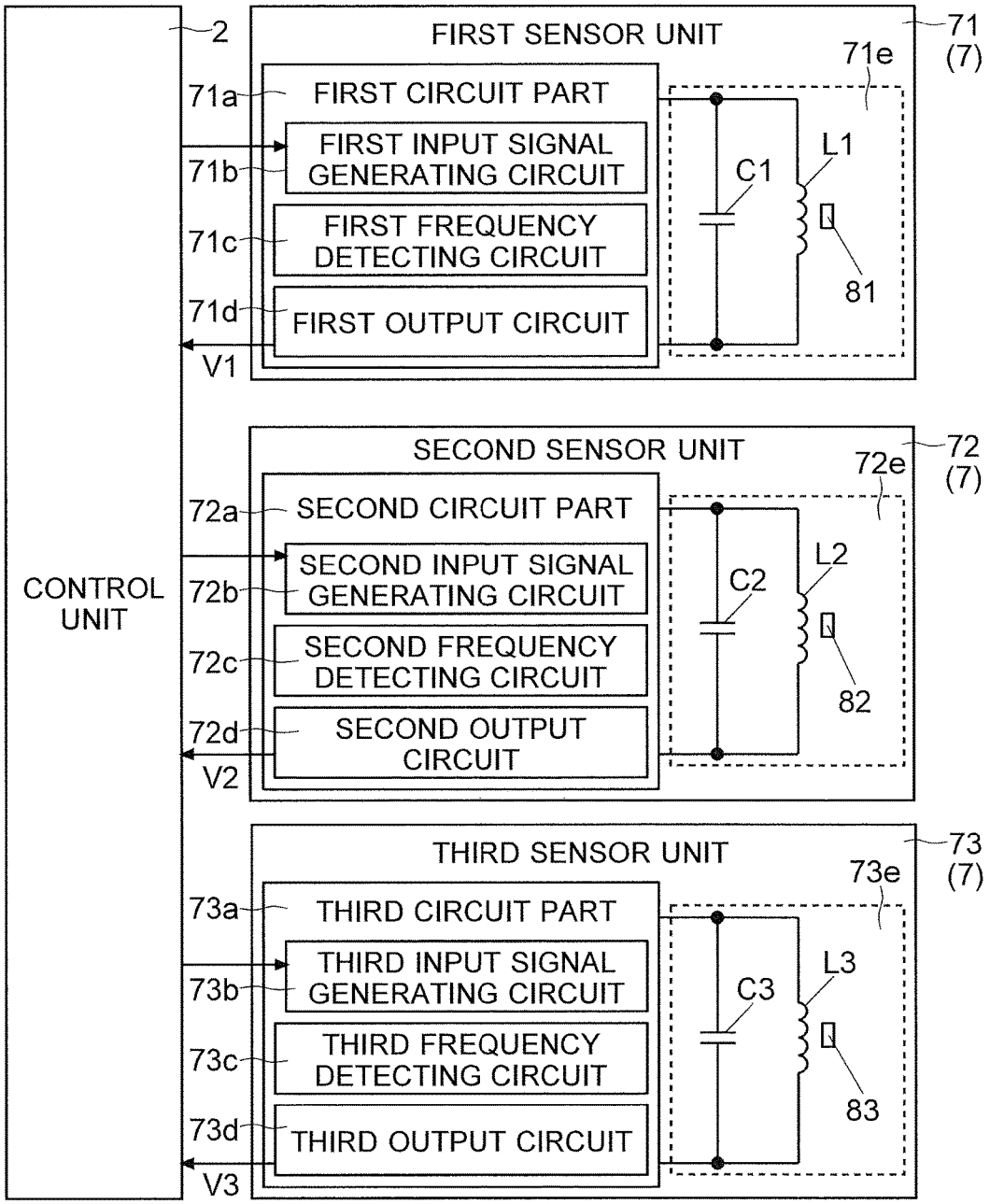
FIG. 5 is a diagram illustrating one example of a sensor unit according to the embodiment.

Next, with reference to FIG. 5, the sensor unit 7 included in the sheet feeding device 1 according to the embodiment is described. The sensor unit 7 includes the first sensor unit 71, the second sensor unit 72, and the third sensor unit 73. The first sensor unit 71 includes a part for detecting remaining quantity of paper sheets set in the sheet feeding device 1 (sheet feeding unit 6*a*). The first sensor unit 71 includes a first circuit part 71*a*, a first coil circuit board L1, a first capacitor C1, and a first conductive plate 81. The first capacitor C1 has a predetermined capacitance. The first capacitor C1 and the first coil circuit board L1 are connected in parallel to terminals of the first circuit part 71*a*. The first coil circuit board L1 and the first capacitor C1 form a first resonant circuit 71*e*. The first coil circuit board L1 is a circuit board on which a coil pattern P1 is printed (details are described later). The first conductive plate 81 is a plate having electrical conductivity. A metal plate such as a stainless steel plate or an aluminum plate can be used as the first conductive plate 81. The first conductive plate 81 has a substantially triangular shape (shape like a part of a crescent moon).

When the cassette 61 is attached, the first conductive plate 81 faces the first coil circuit board L1 in a non-contact manner. In addition, the first conductive plate 81 is moved by a first moving mechanism 9*a* along with upward movement of the sheet placing plate 63. When the first conductive plate 81 moves, a facing area between the first coil circuit board L1 and the first conductive plate 81 is changed. According to a position of the first conductive plate 81, a magnitude of eddy current generated in the first conductive plate 81 or an inductance of the first coil circuit board L1 is changed. As a result, a resonance frequency of the first resonant circuit 71*e* is changed according to a position of the first conductive plate 81.

The first circuit part 71*a* includes a first input signal generating circuit 71*b*, a first frequency detecting circuit 71*c*, and a first output circuit 71*d*. The first input signal generating circuit 71*b* supplies the first resonant circuit 71*e* (first coil circuit board L1) with current (pulse signal) so that resonance occurs. The first frequency detecting circuit 71*c* counts a period of a signal waveform of the first resonant circuit 71*e*. The first frequency detecting circuit 71*c* detects a resonance frequency of the first resonant circuit 71*e*. The first output circuit 71*d* outputs a digital value corresponding to the resonance frequency (period count value) of the first resonant circuit 71*e*, as the first output value V1. The first sensor unit 71 applies a voltage to the first coil circuit board L1 so as to generate a magnetic field. The first sensor unit 71 outputs the first output value V1 corresponding to a position of the first conductive plate 81. The first output value V1 is input to the control unit 2. The control unit 2 recognizes a magnitude of the first output value V1.

The second sensor unit 72 detects a size in a direction perpendicular to the conveying direction. The second sensor unit 72 includes a second circuit part 72*a*, a second coil circuit board L2, a second capacitor C2, and a second conductive plate 82. The second capacitor C2 has a predetermined capacitance. The second capacitor C2 and the second coil circuit board L2 are connected in parallel to terminals of the second circuit part 72*a*. The second coil circuit board L2 and the second capacitor C2 form a second resonant circuit 72*e*. The second coil circuit board L2 is a circuit board on which a coil pattern P2 is printed (details are described later). The second conductive plate 82 is a plate having electrical conductivity. A metal plate such as a stainless steel plate or an aluminum plate can be used as the second conductive plate 82. The second conductive plate 82 has a width in the moving direction smaller than that in the longitudinal direction of the second coil circuit board L2 (details of movement of the second conductive plate 82 are described later).

When the cassette 61 is attached, the second conductive plate 82 faces the second coil circuit board L2 in a non-contact manner. The second conductive plate 82 is moved by a second moving mechanism 9*b* in the longitudinal direction of the second coil circuit board L2. The inductance of the second coil circuit board L2 is changed according to a position of the second conductive plate 82. The resonance frequency of the second resonant circuit 72*e* is changed according to a position of the second conductive plate 82.

The second circuit part 72*a* includes a second input signal generating circuit 72*b*, a second frequency detecting circuit 72*c*, and a second output circuit 72*d*. The second input signal generating circuit 72*b* supplies the second resonant circuit 72*e* (second coil circuit board L2) with current (pulse signal). In this way, the second resonant circuit 72*e* is resonated. The second frequency detecting circuit 72*c* counts a period of a signal waveform of the second resonant circuit 72*e*. The second frequency detecting circuit 72*c* detects a resonance frequency of the second resonant circuit 72*e*. The second output circuit 72*d* outputs a second output value V2. The second output circuit 72*d* outputs a digital value corresponding to the resonance frequency (period count value) of the second resonant circuit 72*e*, as the second output value V2. The second sensor unit 72 applies the second coil circuit board L2 with a voltage so that a magnetic field is generated. The second sensor unit 72 outputs the second output value V2 based on the resonance frequency corresponding to a position of the second conductive plate 82. The second output value V2 is input to the control unit 2. The control unit 2 recognizes a magnitude of the second output value V2.

In addition, the third sensor unit 73 detects a size in a direction parallel to the conveying direction. The third sensor unit 73 includes a third circuit part 73*a*, a third coil circuit board L3, a third capacitor C3, and a third conductive plate 83. The third capacitor C3 has a predetermined capacitance. The third capacitor C3 and the third coil circuit board L3 connected in parallel to terminals of the third circuit part 73*a*. The third coil circuit board L3 and the third capacitor C3 form a third resonant circuit 73*e*. The third coil circuit board L3 is a circuit board on which a coil pattern P3 is printed (details are described later). The third conductive plate 83 is also a plate having electrical conductivity. A metal plate such as a stainless steel plate or an aluminum plate can be used as the third conductive plate 83. The third conductive plate 83 has a width in the moving direction smaller than that in the longitudinal direction of the third coil circuit board L3 (details of movement of the third conductive plate 83 are described later).

When the cassette 61 is attached, the third conductive plate 83 faces the third coil circuit board L3 in a non-contact manner. The third conductive plate 83 is moved by a third moving mechanism 9*c* in the longitudinal direction of the third coil circuit board L3 (details are described later). The inductance of the third coil circuit board L3 is changed according to a position of the third conductive plate 83. The resonance frequency of the third resonant circuit 73*e* is changed according to a position of the third conductive plate 83.

The third circuit part 73*a* includes a third input signal generating circuit 73*b*, a third frequency detecting circuit 73*c*, and a third output part 73*d*. The third input signal generating circuit 73*b* supplies the third resonant circuit 73*e* (third coil circuit board L3) with current (pulse signal). In this way, the third resonant circuit 73*e* is resonated. The third frequency detecting circuit 73*c* counts a period of a signal waveform of the third resonant circuit 73*e*. The third frequency detecting circuit 73*c* detects a resonance frequency of the third resonant circuit 73*e*. The third output part 73*d* outputs a third output value V3. The third output part 73*d* outputs a digital value corresponding to the resonance frequency (period count value) of the third resonant circuit 73*e*, as the third output value V3. The third sensor unit 73 applies the third coil circuit board L3 with a voltage so that a magnetic field is generated. The third sensor unit 73 outputs the third output value V3 corresponding to the resonance frequency according to a position of the third conductive plate 83. The third output value V3 is input to the control unit 2. The control unit 2 recognizes a magnitude of the third output value V3.

(Outline of Detection of Remaining Quantity of Paper Sheets)

Figure 6:
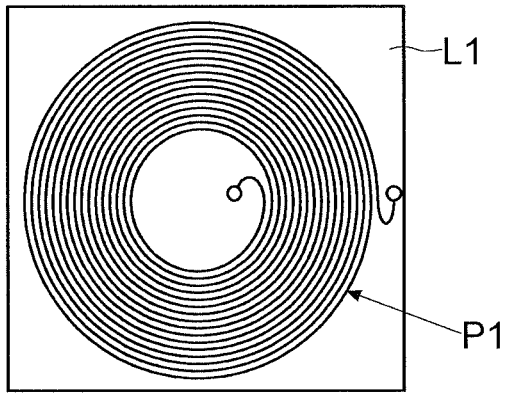
FIG. 6 is a diagram illustrating one example of a first coil circuit board according to the embodiment.
Figure 7:
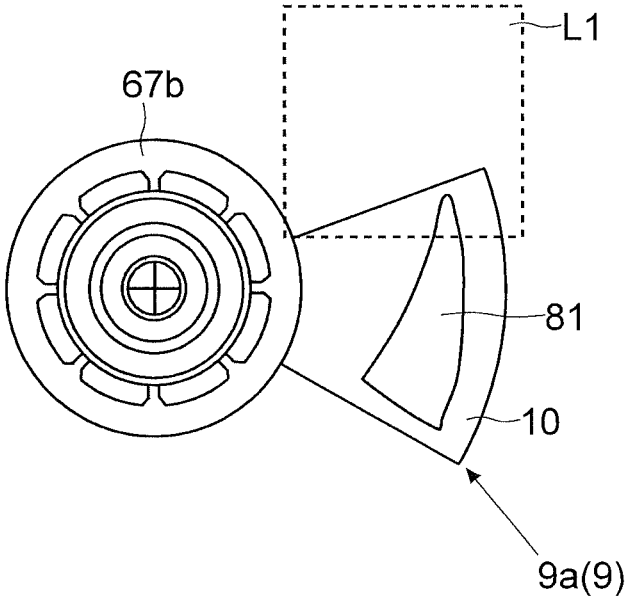
FIG. 7 is a diagram illustrating one example of a first moving mechanism according to the embodiment.
Figure 8:
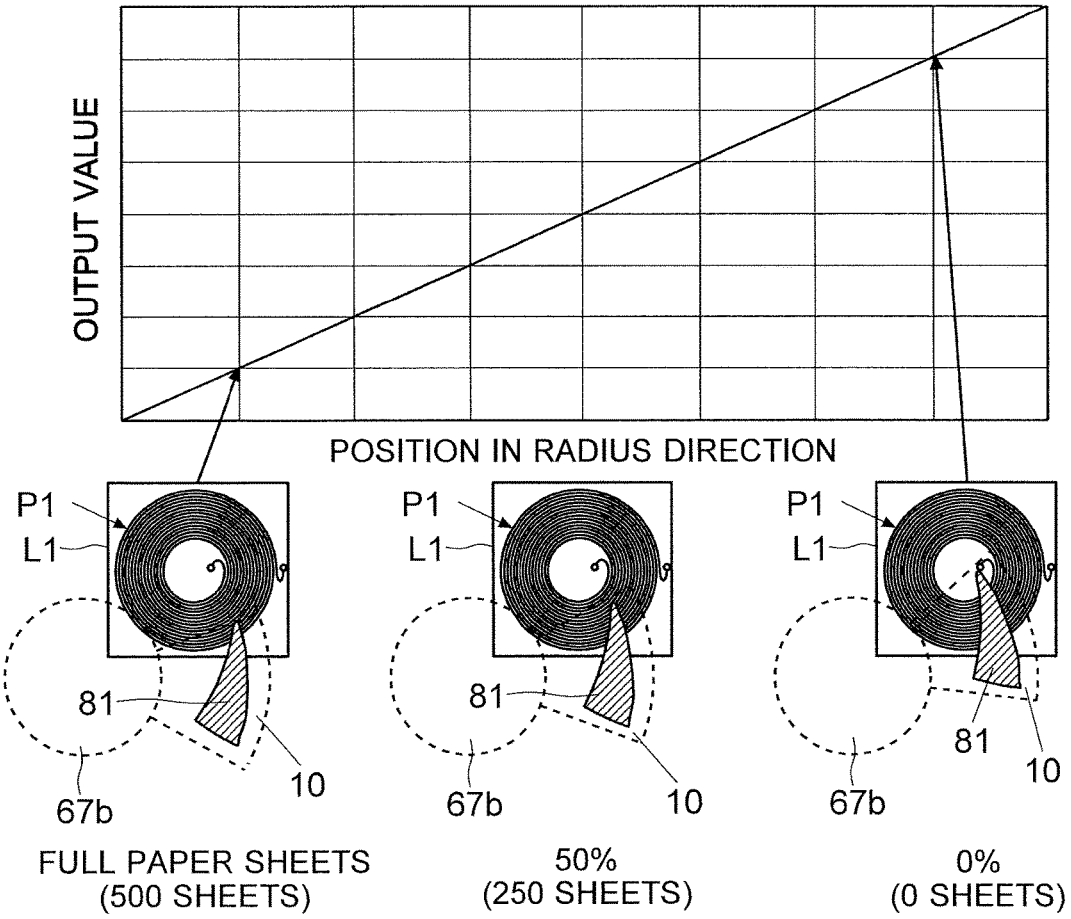
FIG. 8 is a diagram illustrating a first output value of a first sensor unit according to the embodiment.

Next, with reference to FIGS. 6, 7, and 8, detection of remaining quantity of paper sheets in the sheet feeding device 1 according to the embodiment is described. The first coil circuit board L1 is a circuit board on which the coil pattern P1 is printed. As illustrated in FIG. 6, the coil pattern P1 of the first coil circuit board L1 has a circular spiral shape. The first coil circuit board L1 may be a lamination of a plurality of layers of coil patterns P1.

As illustrated in FIG. 7, a fan-shaped rotation plate 10 is fixed to the drive shaft 67*b*, as the first moving mechanism 9*a*. A rotation angle of the rotation plate 10 is changed according to the rotation angle of the drive shaft 67*b*. The first conductive plate 81 is attached to the rotation plate 10.

The first conductive plate 81 is provided to the cassette 61. The first coil circuit board L1 is disposed outside the cassette 61. As the cassette 61 is pulling out, the first conductive plate 81 is separating from the first coil circuit board L1. When the cassette 61 is attached, the first coil circuit board L1 is disposed at a position facing the first conductive plate 81 in a non-contact manner. In other words, when the cassette 61 is attached, the first coil circuit board L1 and the first conductive plate 81 (rotation plate 10) face each other with a short distance (predetermined distance). The first conductive plate 81 is attached to the rotation plate 10 so that the most acute angle part (the tip part of the triangle or crescent) of the first conductive plate 81 is positioned upward. In FIG. 7, a broken line illustrates one example of an attachment position of the first coil circuit board L1 viewed from the horizontal direction. The predetermined distance (between the surface of the first coil circuit board L1 and the surface of the first conductive plate 81) is approximately a few millimeters to five millimeters.

When the drive shaft 67*b* rotates, the facing area between the first conductive plate 81 and the first coil circuit board L1 is changed. FIG. 7 illustrates one example of the position of the first conductive plate 81 when paper sheets are fully stored. In FIG. 7, the facing area between the first conductive plate 81 and the first coil circuit board L1 is relatively small. Along with consumption of paper sheets, the drive shaft 67*b* rotates. The first conductive plate 81 (sheet placing plate 63) moves upward (in the direction to the first coil circuit board L1). The first conductive plate 81 approaches the center of the first coil circuit board L1. In this way, the facing area between the first conductive plate 81 and the first coil circuit board L1 increases.

A winding quantity of the coil pattern P1 facing the first conductive plate 81 is changed according to the position of the first conductive plate 81 (height of the sheet placing plate 63). As illustrated in FIG. 8, as the sheet placing plate 63 moves upper, the winding quantity of the coil facing the first conductive plate 81 becomes more. In other words, as the sheet placing plate 63 moves upper, the facing area between the first coil circuit board L1 and the first conductive plate 81 becomes larger.

A quantity of eddy current in the first conductive plate 81 (magnitude of magnetic force) is changed according to the position of the first conductive plate 81. Strength of magnetic coupling between the first coil circuit board L1 and the first conductive plate 81 is also changed. An inductance (impedance) of the first coil circuit board L1 is also changed. As a result, the first output value V1 of the first circuit part 71*a* becomes a value corresponding to the position of the first conductive plate 81.

FIG. 8 illustrates one example of the output of the first circuit part 71*a*. In the sheet feeding device 1, as there are more paper sheets in the cassette 61 (as the bundle of paper sheets is thicker, or as the sheet placing plate 63 is lower, or as the distance between the sheet placing plate 63 and the sheet feed roller 62*a* is larger), the first output value V1 is smaller. On the contrary, as there are fewer paper sheets in the cassette 61 (as the bundle of paper sheets is thinner, or as the sheet placing plate 63 is higher, or as the distance between the sheet placing plate 63 and the sheet feed roller 62*a* is smaller), the first output value V1 is larger. In addition, the first conductive plate 81 has a substantially triangular shape. In this way, in proportion to the remaining quantity of paper sheets (height of the sheet placing plate 63), the first output value V1 is changed. In other words, a ratio between a variation in height of the sheet placing plate 63 (remaining quantity of paper sheets) and a variation in the first output value V1 is constant.

(Flow of Detection of Remaining Quantity of Paper Sheets)

Figures 9, 10:
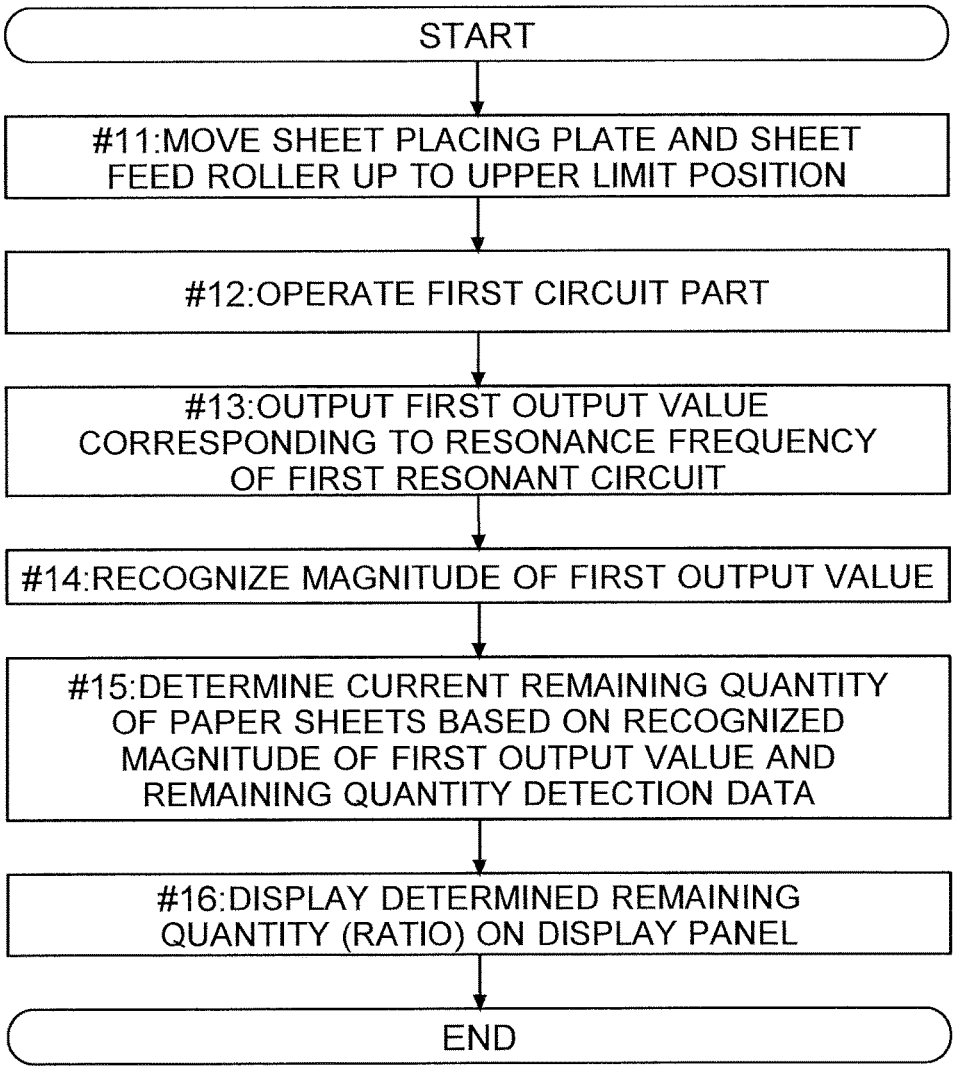
FIG. 9 is a flowchart illustrating one example of a flow of detecting remaining quantity of paper sheets according to the embodiment.
FIG. 10 is a table showing one example of remaining quantity detection data according to the embodiment.

Next, with reference to FIGS. 9 and 10, one example of the detection of remaining quantity of paper sheets according to the embodiment is described. In the sheet feeding device 1 of the multifunction peripheral 100, when a predetermined execution condition for detecting the remaining quantity is satisfied, the detection of remaining quantity of paper sheets is performed. The execution condition can be appropriately determined. The execution condition can be power-on of the multifunction peripheral 100, canceling of power-saving mode (restart of power supply to the sheet feeding unit 6*a* and the first sensor unit 71), pulling out and insertion of the cassette 61, start of a print job (sheet feeding from the sheet feeding unit 6*a*), finish of feeding the last paper sheet for the job, an instruction to the operation panel 5 to detect remaining quantity of paper sheets, or the like.

The flow of FIG. 9 starts when the execution condition for detecting the remaining quantity is satisfied. The control unit 2 controls the sheet feed roller 62*a* (sheet placing plate 63)

to move upward to the upper limit position (Step #11). In this case, the control unit 2 controls the lifting motor 67*a* to operate. Note that when it is recognized that the sheet feed roller 62*a* is at the upper limit position based on the output of the upper limit sensor S1 at a start time point of Step #11, Step #11 may be skipped.

The control unit 2 controls the first circuit part 71*a* to operate (Step #12). In this way, resonance occurs in the first resonant circuit 71*e*. The first circuit part 71*a* outputs the first output value V1 corresponding to the resonance frequency of the first resonant circuit 71*e* (corresponding to the remaining quantity of paper sheets, or corresponding to the thickness of set paper sheets) (Step #13).

The control unit 2 recognizes a magnitude of the first output value V1 (Step #14). On the basis of remaining quantity detection data A1 (stored in the storage unit 3) and the first output value V1, the control unit 2 determines the remaining quantity of set paper sheets (Step #15). The remaining quantity detection data A1 is stored in the storage unit 3. The remaining quantity detection data A1 is data for determining current remaining quantity of paper sheets based on the first output value V1.

With reference to FIG. 10, the remaining quantity detection data A1 is described. As described above, the magnitude of the first output value V1 is a value corresponding to the position of the first conductive plate 81 (height of the sheet placing plate 63 or thickness of the bundle of paper sheets). As illustrated in FIG. 10, a no sheet value and a full sheet value are defined in the remaining quantity detection data A1. The storage unit 3 stores the no sheet value as the remaining quantity detection data A1. The no sheet value is the first output value V1 when the sheet feed roller 62*a* (sheet placing plate 63) is moved upward to the upper limit position in the state without paper sheets. The storage unit 3 also stores the full sheet value as the remaining quantity detection data A1. The full sheet value is the first output value V1 when the sheet feed roller 62*a* (sheet placing plate 63) is moved upward to the upper limit position in the state with full paper sheets.

The number of paper sheets in the cassette 61 that is full is 500 for plain paper sheets. This corresponds to the fact that plain paper sheets available in general are wrapped as a unit of 500 sheets. Note that when the cassette 61 is pulled out, the sheet placing plate 63 falls flat. After that, approximately 500 paper sheets are set. A gap is provided between the top surface of the set bundle of paper sheets and the sheet feed roller 62*a*. This is to prevent the top of the bundle of paper sheets from abutting the sheet feed roller 62*a* when the cassette 61 is restored. After setting paper sheets to full, it is necessary to move the sheet placing plate 63 upward until the uppermost paper sheet contacts with the sheet feed roller 62*a*.

The full sheet value is set to a value of a lower limit value plus a reference variation. The lower limit value is the first output value V1 in a state where the sheet placing plate 63 is fallen flat to the lower limit position. The reference variation is determined in advance. The reference variation is a standard variation of the first output value V1 when the sheet feed roller 62*a* is moved upward to the upper limit position in the state where paper sheets is fully set.

As described above with reference to FIG. 8, the first output value V1 has a constant gradient. A ratio between an upward movement amount of the sheet placing plate 63 (variation in thickness of paper sheets on the sheet placing plate 63) and an increased amount of the first output value V1 is constant. The first output value V1 is linearly changed with respect to a movement amount of the first conductive plate 81. The change of the first output value V1 is linear. Therefore, the control unit 2 determines the current remaining quantity of paper sheets using the recognized first output value V1, no sheet value, and full sheet value (Step #15). The control unit 2 controls the display panel 51 to display the determined remaining quantity (ratio) (Step #16). In this way, detection of remaining quantity of set paper sheets is finished. This flow is finished (END).

The control unit 2 divides an absolute value of a difference between the recognized first output value V1 and the no sheet value by an absolute value of a difference between the no sheet value and the full sheet value. A ratio of the current thickness of the bundle of paper sheets to the thickness of the bundle of full paper sheets is determined. As they are proportional to each other, the remaining quantity detection data A1 can also be a linear function of Z (remaining quantity of paper sheets)=a (gradient)×X (first output value V1)+b (intercept). In this case, the control unit 2 determines the remaining quantity of paper sheets by calculation using the linear function.

(Calculation of Remaining Number of Sheets)

Figure 11:
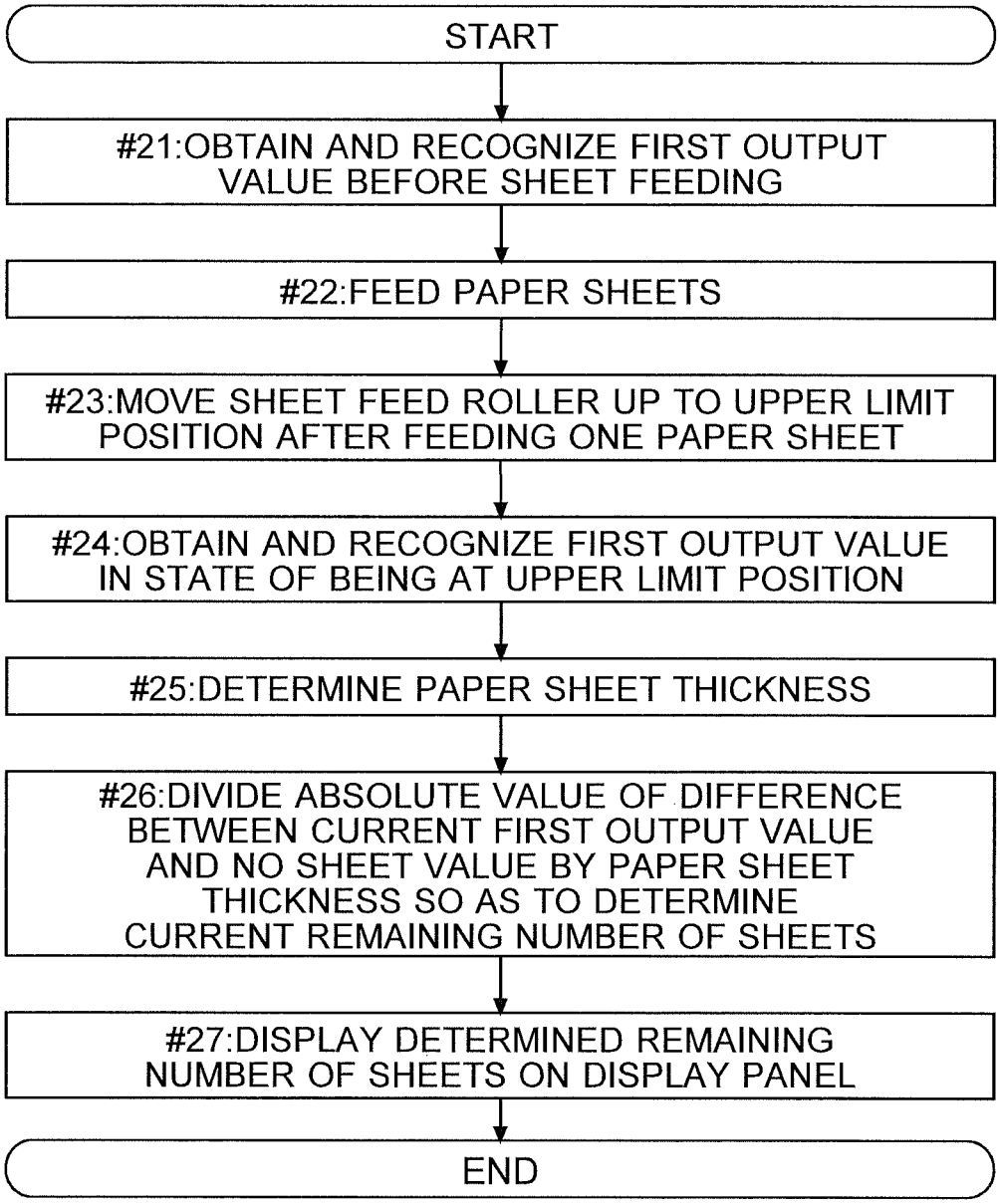
FIG. 11 is a flowchart illustrating one example of a flow of calculating remaining number of sheets according to the embodiment.

Next, with reference to FIG. 11, calculation of the remaining number of sheets in the sheet feeding device 1 according to the embodiment is described. The first sensor unit 71 has a high resolution. The sheet feeding device 1 can determine a variation of the first output value V1 corresponding to a thickness of one paper sheet. The control unit 2 divides the first output value V1 corresponding to the thickness of the set bundle of paper sheets by the first output value V1 corresponding to a thickness of one paper sheet. In this way, the remaining number of paper sheets in the cassette 61 is determined.

First, the flow of FIG. 11 starts when the remaining number of paper sheets is calculated. In the sheet feeding device 1, the calculation time point is when the paper sheet feeding is started. The calculation time point may be other time point. The control unit 2 obtains and recognizes the first output value V1 before the sheet feeding is started (Step #21). The control unit 2 performs the paper sheet feeding (Step #22). After feeding one paper sheet, the control unit 2 controls the lifting motor 67*a* to operate so as to move the sheet feed roller 62*a* upward to the upper limit position (Step #23). The control unit 2 obtains and recognizes the first output value V1 in the state where sheet feed roller 62*a* is moved upward to the upper limit position (Step #24).

The control unit 2 determines the paper sheet thickness (Step #25). The paper sheet thickness is an absolute value of a difference between the first output value V1 obtained in Step #21 and the first output value V1 obtained in Step #24. In other words, the control unit 2 determines the variation of the first output value V1 corresponding to one paper sheet. Next, the control unit 2 determines the current remaining number of sheets (Step #26). The control unit 2 divides an absolute value of a difference between the current first output value V1 and the no sheet value by the paper sheet thickness. An absolute value of a difference between the no sheet value and the current first output value V1 corresponds to a thickness of the remaining bundle of paper sheets. In addition, the paper sheet thickness corresponds to one paper sheet. In other words, the control unit 2 divides a value that corresponds to a thickness of the remaining bundle of paper sheets by a value that corresponds to one paper sheet. In this way, the remaining number of paper sheets in the cassette 61 is determined.

Note that it is possible to configure the operation panel 5 (touch panel 52 or hardware key 53) to accept an input of the thickness of the set paper sheets. Then, the remaining number of sheets may be determined based on the input thickness of the paper sheets. For example, when a predetermined operation is made, the control unit 2 controls the display panel 51 to display a screen for selecting a paper sheet thickness (paper type) from a plurality of types such as thick paper, normal paper, and thin paper. Then, the touch panel 52 accepts the selection of the paper type. The storage unit 3 stores the variation of the first output value V1 when one sheet is fed, for each paper type. On the basis of the data stored in the storage unit 3, the control unit 2 divides the absolute value of a difference between the current first output value V1 and the no sheet value by the variation of the first output value V1 corresponding to one sheet of the selected paper type. In this way, the current remaining number of sheets is determined. The control unit 2 controls the display panel 51 to display the determined remaining number of sheets (Step #27). In this way, the detection of remaining number of sheets is finished. This flow is finished (END).

(Determination Whether or not Cassette 61 is Attached)

Figure 12:
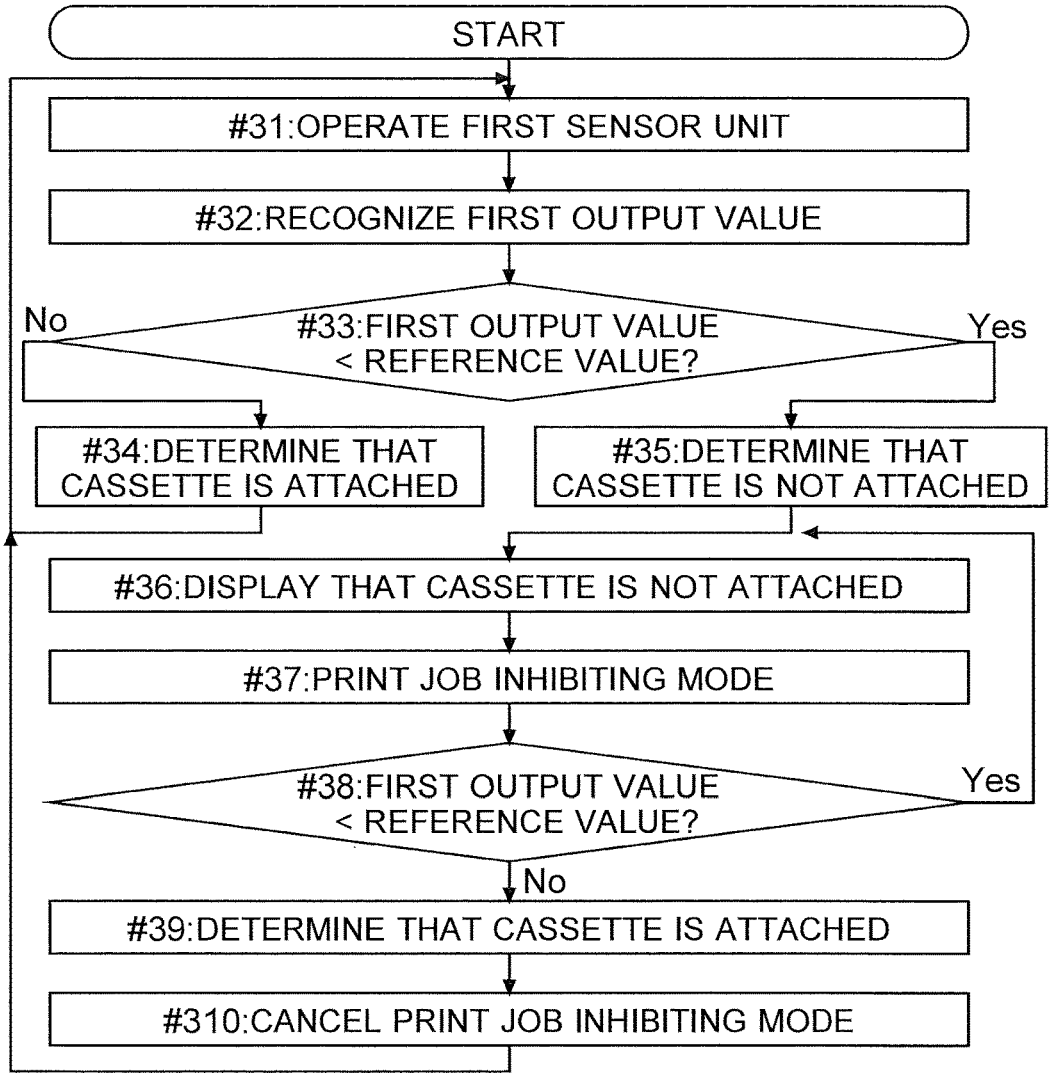
FIG. 12 is a flowchart illustrating one example of a flow of determining whether the cassette is attached or detached according to the embodiment.

Next, with reference to FIG. 12, determination whether or not the cassette 61 is attached according to the embodiment is described. On the basis of an output of the first sensor unit 71 (first output value V1), the control unit 2 determines whether or not the cassette 61 is attached. In the sheet feeding device 1, detection whether or not the cassette 61 is attached (mounted or unmounted) is performed using the first sensor unit 71. A dedicated sensor for detecting whether or not the cassette 61 is attached is not disposed.

During the period while the control unit 2 and the first sensor unit 71 are supplied with power, the control unit 2 periodically checks the first output value V1. Then, the control unit 2 periodically determines whether or not the cassette 61 is attached. The period is appropriately determined. The period may be any period from one second to ten and a few seconds. In addition, the period may be less than one second. The flow of FIG. 12 starts when the control unit 2 and the first sensor unit 71 are supplied with power so that the control unit 2 is activated. In addition, the first sensor unit 71 can also be used in this state. In addition, during the period while the control unit 2 and the first sensor unit 71 are supplied with power, the process of FIG. 12 is continuously performed.

First, the control unit 2 controls the first sensor unit 71 to operate (Step #31). In other words, the control unit 2 controls the first sensor unit 71 to check the resonance frequency of the first resonant circuit 71*e*. Then, the control unit 2 recognizes the first output value V1 output from the first sensor unit 71 (Step #32). In addition, the control unit 2 checks whether or not the first output value V1 is smaller than a reference value A2 (Step #33). The reference value A2 is determined in advance. The storage unit 3 stores the reference value A2 in a nonvolatile manner (see FIG. 1). The reference value A2 is determined based on the lower limit value. In other words, the reference value A2 is determined based on the first output value V1 when the sheet placing plate 63 is at the lower limit position. The reference value A2 may be the lower limit value. In addition, the reference value A2 may be a value of the lower limit value plus a predetermined margin value for preventing misdetection.

As described above, as the facing area between the first coil circuit board L1 and the first conductive plate 81 is larger, the first output value V1 becomes larger. As the magnetic coupling between the first coil circuit board L1 and the first conductive plate 81 is stronger, the first output value V1 becomes larger. Therefore the first sensor unit 71 outputs the first output value V1 of a larger value as a distance between the first coil circuit board L1 and the first conductive plate 81 is smaller. In addition, the first sensor unit 71 outputs the first output value V1 of a smaller value as the distance between the first coil circuit board L1 and the first conductive plate 81 is larger.

The reference value A2 is determined based on the lower limit value. The lower limit value is the lowest value of the first output value V1 that can be output in the state where the cassette 61 is attached. Note that the lower limit value is not zero. When the cassette 61 is detached, the sheet placing plate 63 moves downward by gravity. Further, the distance between the first coil circuit board L1 and the first conductive plate 81 is increased. Therefore, when the cassette 61 is detached (pulled out), the first output value V1 becomes smaller than the reference value A2.

Further, it is possible that a reference value (first reference value) for detecting that the cassette 61 is detached is different from a reference value (second reference value) for detecting that the cassette 61 is attached (mounted). When the cassette 61 is attached, the first output value V1 may be smaller than the reference value A2 by a slight difference. In order to prevent misdetection that the cassette 61 is not attached, the second reference value may be smaller than the first reference value. In this case, the first reference value and the second reference value are stored in the storage unit 3. When detecting that the cassette 61 is attached, the control unit 2 switches the reference value A2 to be used to the first reference value. When the power is turned on or when detecting that the cassette 61 is not attached, the control unit 2 switches the reference value A2 to be used to the second reference value.

The control unit 2 checks whether or not the first output value V1 is smaller than the reference value A2 (Step #33). When the first output value V1 is larger than or equal to the reference value A2 (No in Step #33), the control unit 2 determines that the cassette 61 is attached (Step #34). Then, the flow returns to Step #31.

On the other hand, when the first output value V1 is smaller than the reference value A2 (Yes in Step #33), the control unit 2 determines that the cassette 61 is not attached (Step #35). When determining that the cassette 61 is not attached, the control unit 2 controls the display panel 51 to display a message informing that the cassette 61 is not attached (Step #36).

Further, the control unit 2 controls the sheet feeding device 1 and the printing unit 6 to be in a print job inhibiting mode (Step #37). When switching to the print job inhibiting mode in a state where the print job is not being executed, the control unit 2 does not allow the sheet feeding device 1 and the printing unit 6 to operate. In other words, the control unit 2 does not allow to perform sheet feeding and image forming. When switching to the print job inhibiting mode in a state where the print job is being executed, the control unit 2 controls the printing unit 6 to print only on the paper sheet that is already fed. Then, the control unit 2 does not allow sheet feeding of a new paper sheet and toner image forming by transferring onto a new paper sheet by the printing unit 6. Note that in a case where a plurality of sheet feeding units 6*a* are disposed and the other sheet feeding unit 6*a* can feed a paper sheet, the control unit 2 may not control the sheet feeding device 1 to be in the print job inhibiting mode.

Then, the control unit 2 checks again whether or not the first output value V1 is smaller than the reference value A2 (Step #38). When the first output value V1 is smaller than the reference value A2 (No in Step #38), the flow returns to Step #36. The control unit 2 maintains the determination that the cassette 61 is not attached. On the other hand, when the first output value V1 is larger than or equal to the reference value A2 (No in Step #38), the control unit 2 determines that the cassette 61 is attached (Step #39). Then, the control unit 2 cancels the print job inhibiting mode (Step #310). In other words, the control unit 2 restores the sheet feeding device 1 and the image forming apparatus to a print job executable mode. Then, the flow returns to Step #31.

Note that when using the first sensor unit 71, whose first output value V1 becomes larger as the magnetic coupling between the first coil circuit board L1 and the first conductive plate 81 is weaker, the reference value A2 is determined based on the upper limit value. In this case, the upper limit value is the maximum value of the first output value V1 that can be output in the state where the cassette 61 is attached. Note that the upper limit value is smaller than the maximum value that the first sensor unit 71 can output. When the cassette 61 is detached (pulled out), the first output value V1 becomes larger than the reference value A2. In this case, when the first output value V1 is larger than or equal to reference value A2, the control unit 2 determines that the cassette 61 is not attached. In addition, when the first output value V1 is smaller than the reference value A2, the control unit 2 determines that the cassette 61 is attached.

When detecting that the cassette 61 is attached, the control unit 2 may automatically update the full sheet value. When the control unit 2 determines that the cassette 61 is attached (No in Step #38, and Step #39), the control unit 2 recognizes a magnitude of the first output value V1. The control unit 2 determines a new value of the full sheet value based on the recognized first output value V1. Then, the control unit 2 controls the storage unit 3 to update the full sheet value to the new value. Further, the control unit 2 may automatically update the no sheet value to be associated with the full sheet value. When the control unit 2 recognizes that there are no paper sheets based on the output of the set sensor S2, the control unit 2 controls the sheet placing plate 63 (sheet feed roller 62*a*) to move upward to the upper limit position. Then, the control unit 2 recognizes a magnitude of the first output value V1. The control unit 2 controls the storage unit 3 to update the no sheet value to the recognized value. In this way, accurate remaining quantity can be detected all the time.

(Adjustment of Reference Value A2)

Figure 13:
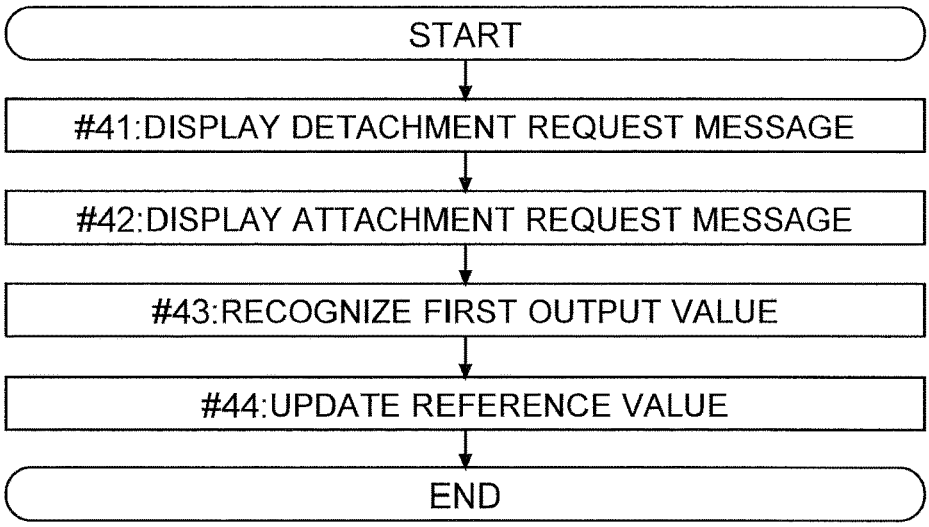
FIG. 13 is a flowchart illustrating one example of a flow of an update process of a reference value according to the embodiment.

Next, with reference to FIG. 13, one example of the adjustment process of the reference value A2 according to the embodiment is described. The first output value V1 is affected by the distance between the first coil circuit board L1 and the first conductive plate 81, and a position relationship between them. The position of the first coil circuit board L1 or the position of the first conductive plate 81 may be shifted during use (the possibility is not zero). As a result, when the cassette 61 is attached, misdetermination that the cassette 61 is not attached may occur (the possibility is not zero). In addition, the position of the first coil circuit board L1 or the position of the first conductive plate 81 may vary among the sheet feeding devices 1 (image forming apparatuses). In addition, the cassette 61 may be exchanged due to a breakdown. The set reference value A2 is not always appropriate.

Therefore, in the sheet feeding device 1, the reference value A2 can be adjusted. The flow of FIG. 13 starts when the operation panel 5 (the touch panel 52 or the hardware key 53) accepts an instruction to adjust the reference value. First, the control unit 2 controls the display panel 51 to display a message requesting to detach (pull out) the cassette 61 (Step #41). In this way, the user detaches the cassette 61. As a result, the sheet placing plate 63 moves downward to the lower limit position.

Next, the control unit 2 controls the display panel 51 to display a message requesting to attach (mount) the cassette 61 (Step #42). The control unit 2 may control the operation panel 5 to display a detachment confirmation button. Further, when the detachment confirmation button is operated, the control unit 2 may control the display panel 51 to display an attachment request message.

The control unit 2 recognizes the first output value V1 (Step #43). The control unit 2 may control the operation panel 5 to display an attachment confirmation button. Further, when the attachment confirmation button is operated, the control unit 2 may recognize the first output value V1. The recognized first output value V1 is the lower limit value. Further, when the cassette 61 is attached, the control unit 2 recognizes the first output value V1 (lower limit value) before the sheet placing plate 63 moves upward. A new value of the reference value A2 is determined based on the recognized first output value V1. The control unit 2 controls the storage unit 3 to update the reference value A2 to the new value (Step #44).

(Outline of Sheet Size Detection)

Figure 14:
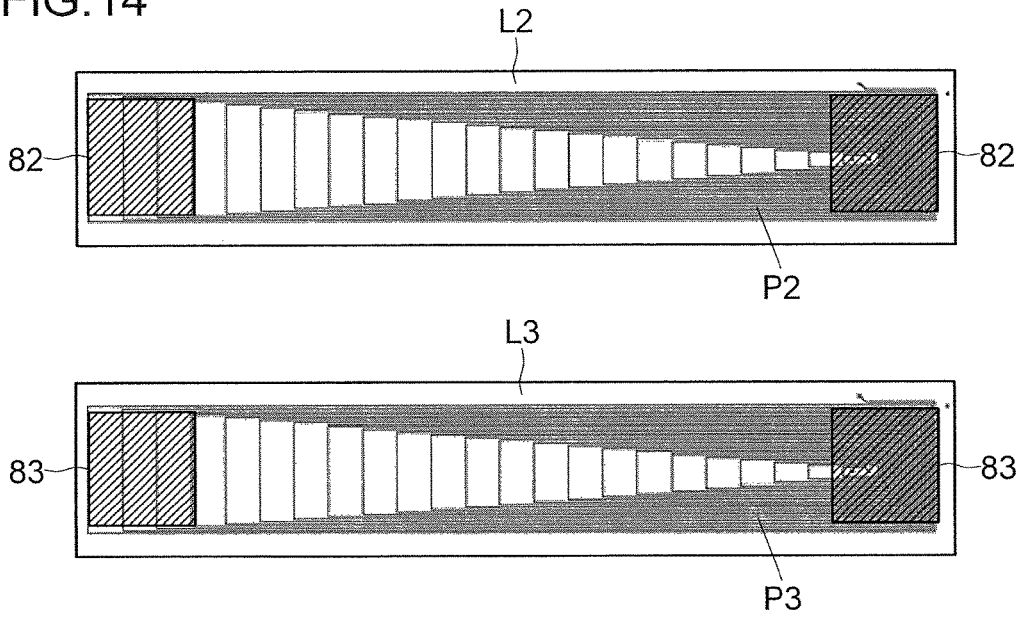
FIG. 14 is a diagram illustrating one example of a second coil circuit board and a third coil circuit board according to the embodiment.
Figure 15:
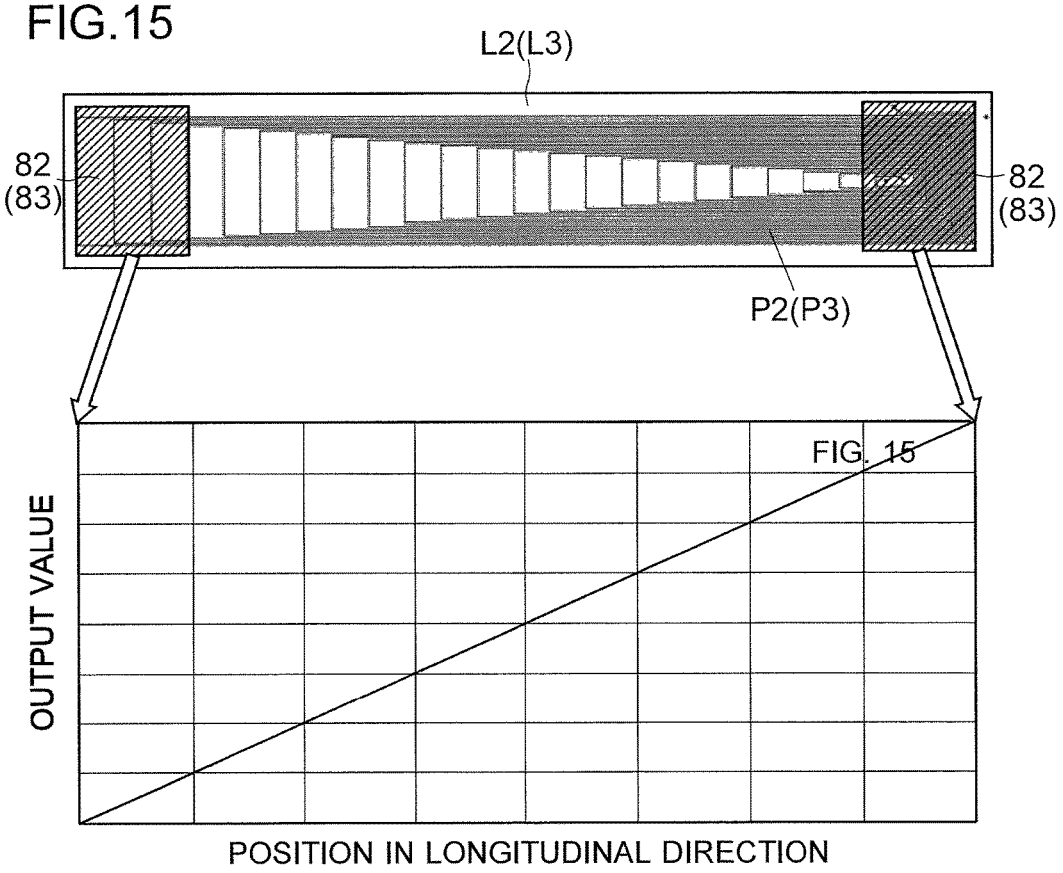
FIG. 15 is a diagram illustrating one example of the output values of the sensor units corresponding to positions of a second conductive plate and a third conductive plate according to the embodiment.

Next, with reference to FIGS. 14 and 15, sheet size detection of the sheet feeding device 1 according to the embodiment is described. The second coil circuit board L2 is a circuit board on which the coil pattern P2 is printed. The third coil circuit board L3 is a circuit board on which the coil pattern P3 is printed. As illustrated in FIG. 14, the coil pattern P2 and the coil pattern P3 have rectangular spiral shapes. As illustrated in FIG. 14, the center of the spiral of each of the coil pattern P2 and the coil pattern P3 is positioned at one end on each coil circuit board.

On the second coil circuit board L2 and the third coil circuit board L3, a length in the longitudinal direction of the winding becomes gradually shorter toward the inside winding. For example, when n represents a length in the longitudinal direction of the most inside winding, a length in the longitudinal direction of a winding is (number of turns)×n. On the other hand, an interval between windings in the short direction is set as small as possible. The coil pattern P2 is formed so that the winding quantity facing the second conductive plate 82 varies according to a position of the second conductive plate 82. The coil pattern P3 is also formed so that the winding quantity facing the third conductive plate 83 varies according to a position of the third conductive plate 83.

The winding quantity facing the second conductive plate 82 varies according to a position of the second conductive plate 82. In other words, density of the winding facing the second conductive plate 82 varies according to a position of the second conductive plate 82. In the example illustrated in FIG. 14, as the second conductive plate 82 moves rightward more on the coil pattern P2, the winding quantity facing the second conductive plate 82 becomes larger. According to a position of the second conductive plate 82, quantity of eddy current (magnitude of magnetic force) in the second conductive plate 82 varies. According to a position of the second conductive plate 82, strength of magnetic coupling between the second conductive plate 82 and the second coil circuit board L2 varies. According to a position of the second conductive plate 82, inductance (impedance) of the second coil circuit board L2 varies. As the resonance frequency varies, an output value of the second circuit part 72*a* varies according to a position of the second conductive plate 82.

The winding quantity facing the third conductive plate 83 varies according to a position of the third conductive plate 83. In other words, density of the winding facing the third conductive plate 83 varies according to a position of the third conductive plate 83. In the example illustrated in FIG. 14, as the third conductive plate 83 moves rightward more on the coil pattern P3, the winding quantity of the coil facing the third conductive plate 83 becomes larger. According to a position of the third conductive plate 83, quantity of eddy current (magnitude of magnetic force) in the third conductive plate 83 varies. According to a position of the third conductive plate 83, strength of magnetic coupling between the third conductive plate 83 and the third coil circuit board L3 varies. According to a position of the third conductive plate 83, inductance (impedance) of the third coil circuit board L3 varies. As the resonance frequency varies, an output value of the third circuit part 73*a* varies according to a position of the third conductive plate 83.

FIG. 15 illustrates one example of an output of the second circuit part 72*a* (second output value V2). In FIG. 15, when the second conductive plate 82 is on the left side, the second output value V2 (resonance frequency) is small. As the second conductive plate 82 moves rightward more, the second output value V2 becomes larger. An initial position is a state where the second conductive plate 82 faces the coil pattern P2 of the second coil circuit board L2 so that the left ends of them coincide each other. FIG. 15 illustrates an example where the second output value V2 becomes larger in proportion to a rightward moving distance from the initial position. Note that a relationship between a position of the third conductive plate 83 and the third output value V3 (resonance frequency) of the third circuit part 73*a* is similar to that of the second conductive plate 82 (the relationship as illustrated in FIG. 15).

(Second Moving Mechanism 9*b*)

Figure 16:
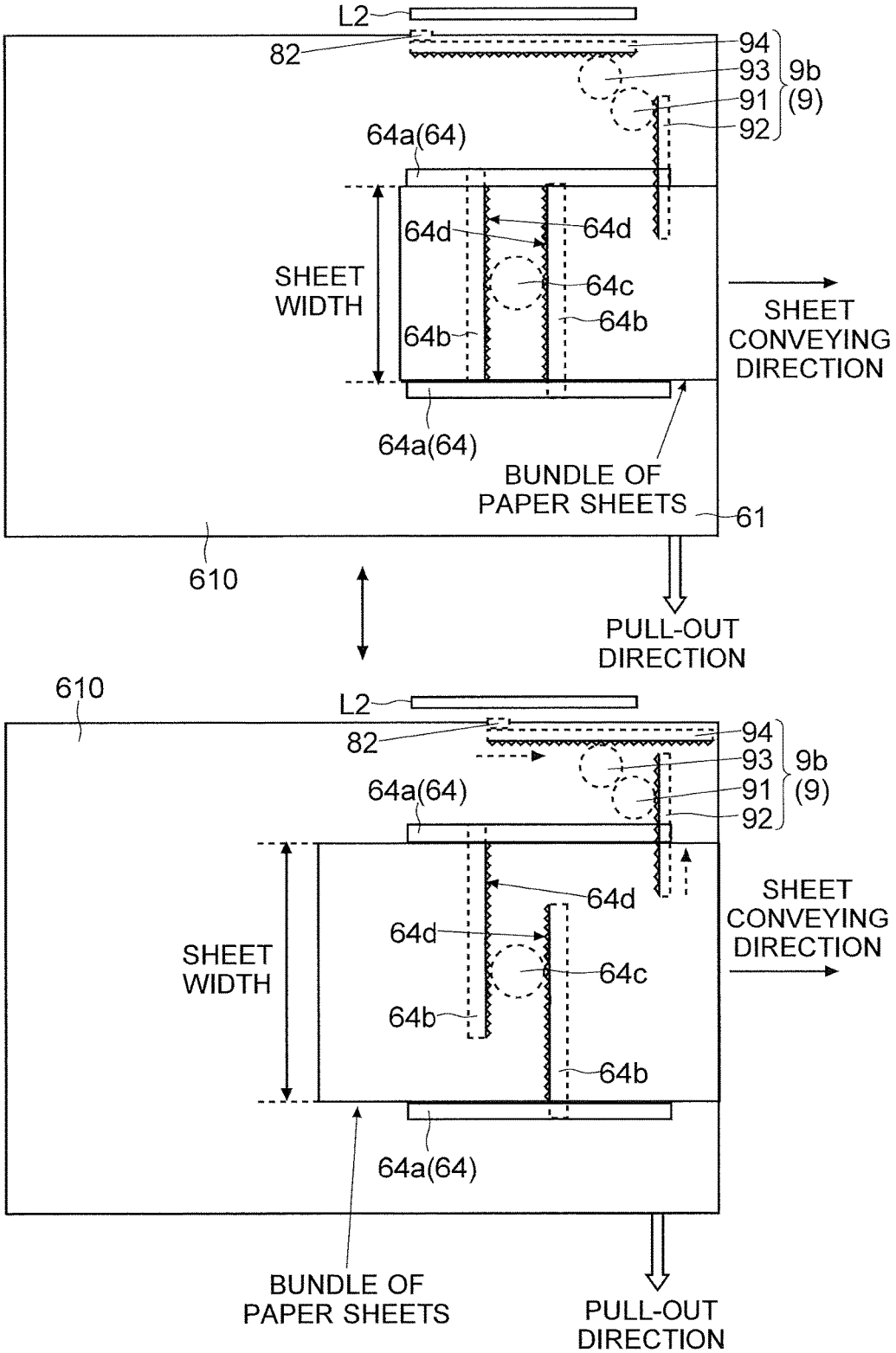
FIG. 16 is a diagram illustrating one example of a second moving mechanism according to the embodiment.

Next, with reference to FIGS. 2 and 16, the second moving mechanism 9*b* according to the embodiment is described. As illustrated in FIG. 2, the cassette 61 has a two-layered structure with a partition plate 610 (bottom plate) as a border. The sheet placing plate 63 and the width regulation cursor pair 64 are disposed inside an upper layer 611 (above the bottom plate). The second moving mechanism 9*b* and the second conductive plate 82 for detecting a size in the direction perpendicular to the conveying direction of the set paper sheets are disposed inside a lower layer 612. In other words, the second conductive plate 82 is disposed in the cassette 61. On the other hand, the second coil circuit board L2 is not disposed in the cassette 61. The second coil circuit board L2 is disposed on the main body side of the multifunction peripheral 100. The second coil circuit board L2 is disposed at a position that faces the second conductive plate 82 in a non-contact manner when the cassette 61 is attached. Note that in FIG. 2, the second moving mechanism 9*b* and the second conductive plate 82 are not shown for convenience sake of illustration. In addition, in FIG. 16, the direction of pulling out the cassette 61 is shown by a white arrow.

FIG. 16 is a diagram of the sheet feeding unit 6*a* (sheet feeding device 1) viewed from above. In addition, in FIG. 16, members disposed in the lower layer 612 are shown by broken lines. In addition, the sheet placing plate 63 is not shown in FIG. 16. The lower part of FIG. 16 illustrates a state where paper sheets having a larger size in the direction perpendicular to the conveying direction than in the upper part are set.

As illustrated in FIG. 16, the width regulation cursor pair 64 is disposed on the upper surface of the partition plate 610. The paper sheets are set on the upper surface of the partition plate 610. The width regulation cursors 64*a* are parallel to the conveying direction. Each of the width regulation cursors 64*a* is a plate-like member disposed to stand vertically on the partition plate 610. The width regulation cursors 64*a* move to slide in the direction perpendicular to the conveying direction. The inner surfaces of the width regulation cursors 64*a* contact with side faces (edges in the width direction) of the paper sheets set in the cassette 61. The inner surfaces of the width regulation cursors 64*a* face each other. The user moves the width regulation cursor pair 64 to fit a size (width) of the set paper sheets. In this way, the position of the set paper sheets can be regulated. As illustrated in FIG. 16, positions of the width regulation cursors 64*a* (distance between the width regulation cursors 64*a*) varies according to a size of the set paper sheets.

A linkage member 64*b* is disposed below each of the width regulation cursors 64*a* (below the partition plate 610). The linkage member 64*b* has a longitudinal direction that is perpendicular to the conveying direction. The linkage member 64*b* is a member like a plate, a rod, or a column. The linkage member 64*b* is attached perpendicularly to each of the width regulation cursors 64*a* viewed from above. The linkage member 64*b* is positioned in the lower layer 612 of the cassette 61. One linkage members 64*b* and the other linkage member 64*b* are disposed at different positions in the conveying direction.

A rotation member 64*c* is disposed at the center position between the inner surfaces of the width regulation cursors 64*a*. The rotation member 64*c* is disposed between the linkage members 64*b*. The rotation member 64*c* is also disposed in the lower layer 612. The rotation member 64*c* has a rotation axis perpendicular to a paper sheet placing surface (partition plate 610). The outer circumferential surface of the rotation member 64*c* is provided with teeth. In addition, each of the linkage members 64*b* is also provided with a teethed surface 64*d*. The teethed surface 64*d* is provided to one of sides of the linkage member 64*b* on the rotation member 64*c* side. The teethed surface 64*d* of each linkage members 64*b* is disposed so as to engage with the teeth of the rotation member 64*c*.

The teethed surfaces 64*d* of the linkage members 64*b* engage with the rotation member 64*c*. Therefore, when one of the width regulation cursors 64*a* is moved, the other width regulation cursor 64*a* is also moved (in linkage therewith). Specifically, when one of the width regulation cursors 64*a* is moved inward, the other width regulation cursor 64*a* is also moved inward. When one of the width regulation cursors 64*a* is moved outward, the other width regulation cursor 64*a* is also moved outward. The linkage movement of the width regulation cursors 64*a* enables the center of paper sheets in the direction perpendicular to the conveying direction to coincide with the center of the sheet conveying path in the width direction (center sheet feeding) even if any size of paper sheets are set.

The second coil circuit board L2 is disposed outside of the cassette 61. The longitudinal direction of the second coil circuit board L2 is parallel to the conveying direction. The second moving mechanism 9*b* is disposed in the lower layer 612 of the cassette 61. The second moving mechanism 9*b* moves the second conductive plate 82 in the longitudinal direction of the second coil circuit board L2 according to positions of the cursors. The second moving mechanism 9*b* includes a first gear 91, a first rack 92, a second gear 93, and a second rack 94. The first rack 92 is connected to one of the width regulation cursors 64*a*. The first rack 92 is attached to the width regulation cursor 64*a*. The longitudinal direction of the first rack 92 is perpendicular to the conveying direction. The first rack 92 moves in the direction perpendicular to the conveying direction along with the movement of the width regulation cursor 64*a*.

Teeth of the first rack 92 are engaged with the first gear 91. In addition, the first gear 91 and the second gear 93 are engaged with each other. Teeth of the second rack 94 are engaged with the second gear 93. In addition, the second rack 94 faces the second coil circuit board L2. The longitudinal direction of the second rack 94 is parallel to the conveying direction. The second rack 94 moves in the conveying direction along with rotation of the second gear 93. Therefore, the longitudinal direction of the second rack 94 and a movement direction thereof are parallel to the longitudinal direction of the second coil circuit board L2.

The second conductive plate 82 is attached to the second rack 94. As illustrated in FIG. 16, the second conductive plate 82 is attached to a surface of the second rack 94 that faces the second coil circuit board L2. A part of the second conductive plate 82 (the surface facing the second coil circuit board L2) is exposed to outside of the case of the cassette 61. In order to expose the second conductive plate 82, the case of the cassette 61 is provided with a groove. In this way, the second conductive plate 82 and the second coil circuit board L2 can be close to each other. Note that it is possible to adopt a structure in which the groove is not provided so that the second conductive plate 82 is not exposed to outside of the case.

The second conductive plate 82 is attached to the end of the second rack 94 on the upstream side in the conveying direction. The second moving mechanism 9*b* (the first rack 92, the first gear 91, the second gear 93, and the second rack 94) converts the movement of the width regulation cursor 64*a* in the direction perpendicular to the conveying direction to the movement in a direction parallel to the conveying direction. According to a position of the width regulation cursor 64*a*, the second moving mechanism 9*b* moves the second conductive plate 82 in the longitudinal direction of the second coil circuit board L2. In this way, the winding quantity facing the second conductive plate 82 varies.

The lower part of FIG. 16 illustrates an example where the second conductive plate 82 moves to the downstream side in the conveying direction. When a distance between the width regulation cursor pairs 64 is increased, the first rack 92 moves. In this way, the first gear 91 and the second gear 93 rotate. Then, the second rack 94 moves to the downstream side in the conveying direction. The second conductive plate 82 moves within a range from a position when usable minimum size of paper sheets are set to a position when usable maximum size of paper sheets are set. The movement of the second conductive plate 82 is within a range between both ends of the coil pattern P2 of the second coil circuit board L2 in the longitudinal direction. In order that the movement is within the range between the both ends, a gear ratio between the first gear 91 and the second gear 93 is adjusted. Even when any size of paper sheets are set, the second coil circuit board L2 and the second conductive plate 82 face each other.

(Third Moving Mechanism 9*c*)

Figure 17:
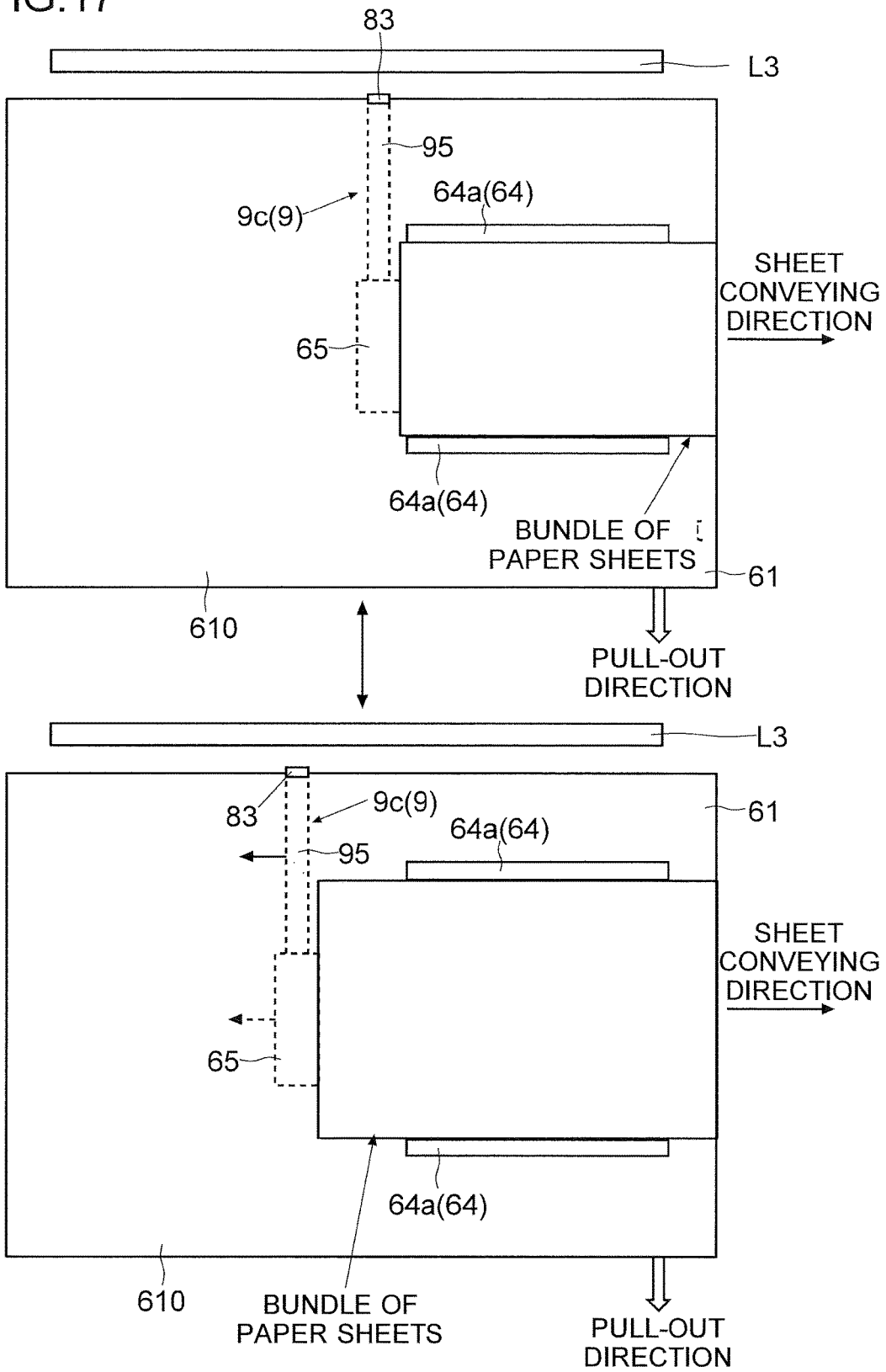
FIG. 17 is a diagram illustrating one example of a third moving mechanism according to the embodiment.

Next, with reference to FIGS. 2 and 17, the third moving mechanism 9*c* according to the embodiment is described. As illustrated in FIG. 2, the third moving mechanism 9*c* and the third conductive plate 83 are disposed inside the lower layer 612 of the cassette 61. The third conductive plate 83 is disposed in the cassette 61. On the other hand, the third coil circuit board L3 is not disposed in the cassette 61. The third coil circuit board L3 is disposed on the main body side of the multifunction peripheral 100. The third coil circuit board L3 is disposed at a position facing the third conductive plate 83 in a non-contact manner when the cassette 61 is attached. The third moving mechanism 9*c* is a mechanism for detecting a size of the set paper sheet in the conveying direction. Note that the third moving mechanism 9*c* and the third conductive plate 83 are not shown in FIG. 2 for convenience sake of illustration.

FIG. 17 is a diagram of the sheet feeding unit 6*a* (sheet feeding device 1) viewed from above. In addition, members disposed in the lower layer 612 of the cassette 61 are shown by a broken line in FIG. 17. The sheet placing plate 63 is not shown in FIG. 17. The lower part of FIG. 17 illustrates a state where paper sheets having a larger size than in the upper part are set. The paper sheets are set on the upper surface of the partition plate 610. The rear end regulation cursor 65 is disposed on the upper surface of the partition plate 610. The rear end regulation cursor 65 regulates a rear end position of the set paper sheets.

The rear end regulation cursor 65 moves to slide in the direction parallel to the conveying direction. The inner surface of the rear end regulation cursor 65 contacts with the rear end of the set paper sheets (edge on the upstream side in the conveying direction). As illustrated in FIG. 17, a position of the rear end regulation cursor 65 varies according to a size of the set paper sheets. The user moves the rear end regulation cursor 65 according to a size (length) of the set paper sheets. In this way, a position of the set paper sheets can be regulated. The third coil circuit board L3 is disposed outside of the cassette 61. The longitudinal direction of the third coil circuit board L3 is parallel to the conveying direction. The third moving mechanism 9*c* is disposed inside the cassette 61. The third moving mechanism 9*c* is disposed in the lower layer 612 of the cassette 61. The third moving mechanism 9*c* moves the third conductive plate 83 in the longitudinal direction of the third coil circuit board L3 according to a position of the rear end regulation cursor 65.

The third moving mechanism 9*c* includes a rod member 95. One end of the rod member 95 is connected (attached) to the rear end regulation cursor 65. The longitudinal direction of the rod member 95 is perpendicular to the conveying direction. The other end of the rod member 95 faces the third coil circuit board L3. The third conductive plate 83 is attached to the other end of the rod member 95. A part of the third conductive plate 83 (surface facing the third coil circuit board L3) is exposed to outside of the case of the cassette 61. In order to expose the third conductive plate 83, the case of the cassette 61 is provided with a groove. In this way, the third conductive plate 83 and the third coil circuit board L3 can be close to each other. Note that it is possible to adopt a structure in which the groove is not provided so that the third conductive plate 83 is not exposed to outside of the case. The third moving mechanism 9*c* moves the rod member 95 according to a position of the rear end regulation cursor 65. The third conductive plate 83 moves in the longitudinal direction of the third coil circuit board L3. In this way, the winding quantity facing the third conductive plate 83 varies.

The lower part of FIG. 17 illustrates an example where a position of the third conductive plate 83 is moved to the upstream side in the conveying direction. Together with movement of the rod member 95, the third conductive plate 83 is moved. Note that the third conductive plate 83 moves within a range from a position when usable minimum size of paper sheets are set to a position when usable maximum size of paper sheets are set. The movement of the third conductive plate 83 is within a range between both ends of the coil pattern P3 of the third coil circuit board L3 in the longitudinal direction. A length of the third conductive plate 83 is set to be longer than the movement range. Even when any size of paper sheets are set, the third coil circuit board L3 and the third conductive plate 83 face each other.

(Flow of Sheet Size Detection)

Figure 18:
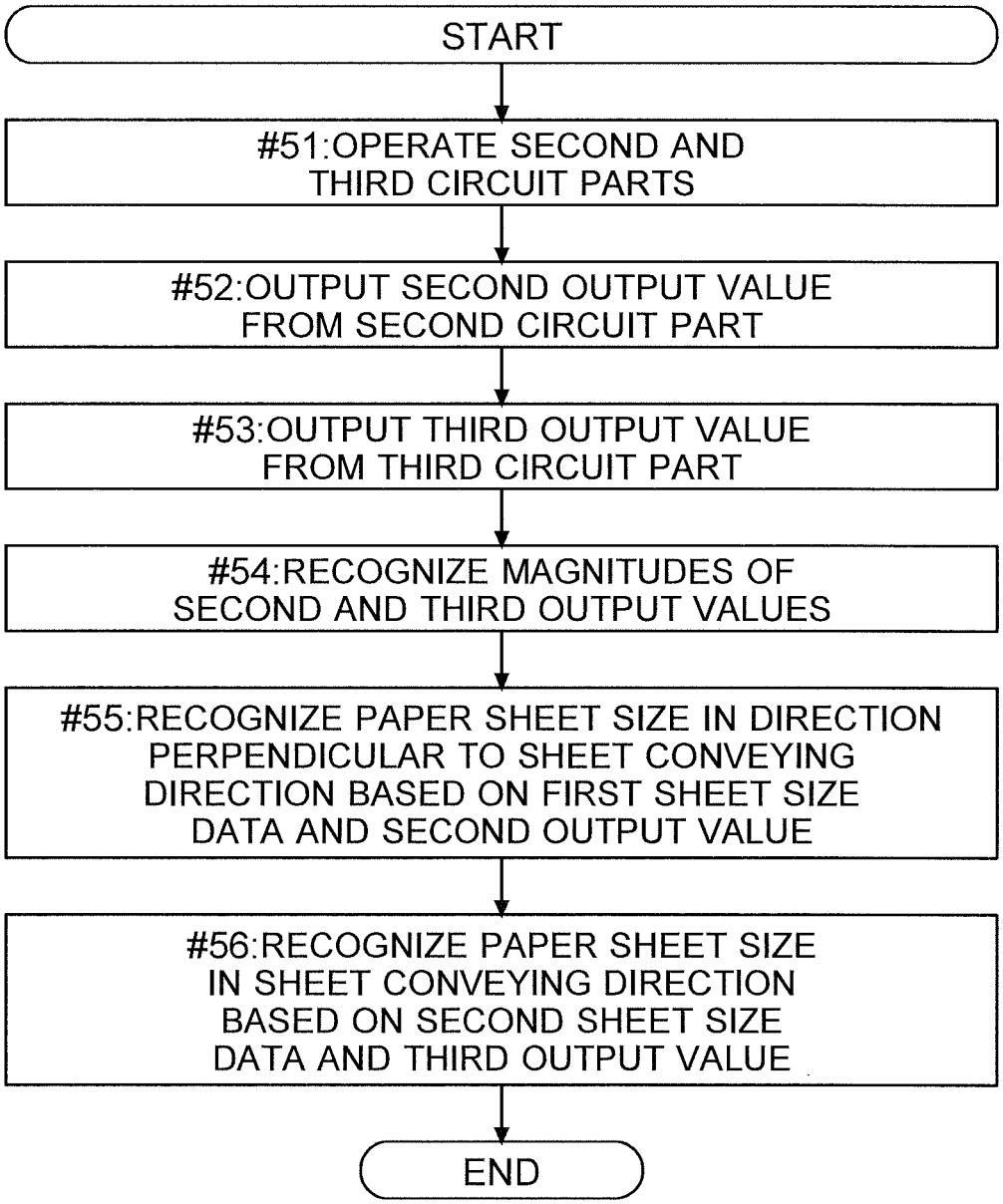
FIG. 18 is a flowchart illustrating one example of a flow of detecting a sheet size according to the embodiment.

Next, with reference to FIGS. 18 to 20, one example of a flow of the sheet size detection in the sheet feeding device 1 according to the embodiment is described. The flow of FIG. 18 starts when the control unit 2 determines that the cassette 61 is attached. In this case, based on the magnitude of the second output value V2 and first sheet size data D1, the control unit 2 recognizes a size of the set paper sheets in the direction perpendicular to the conveying direction. When determining that the cassette 61 is attached, the control unit 2 recognizes a size of the set paper sheets in the conveying direction based on the magnitude of the third output value V3 and second sheet size data D2. In this way, when a distance between the conductive plate and a corresponding coil circuit board becomes the distant in measurement (attachment), the sheet size detection is performed. Therefore a sheet size can be correctly detected. Note that the time point when the sheet size detection is performed is not limited to the above-mentioned time point. The control unit 2 may perform the sheet size detection at any time point during the period while it is determined that the cassette 61 is attached.

First, the control unit 2 operates the second circuit part 72*a* and the third circuit part 73*a* (Step #51). The second circuit part 72*a* outputs the second output value V2 corresponding to the resonance frequency (Step #52). The third circuit part 73*a* outputs the third output value V3 corresponding to the resonance frequency (Step #53). The control unit 2 recognizes magnitudes of the second output value V2 and the third output value V3 (Step #54). The control unit 2 recognizes a size of the set paper sheets in the direction perpendicular to the conveying direction based on the first sheet size data D1 (stored in the storage unit 3) and the second output value V2 (Step #55).

With reference to FIG. 19, the first sheet size data D1 is described. The magnitude of the second output value V2 corresponds to a position of the second conductive plate 82 (position of the width regulation cursor pair 64). As illustrated in FIG. 19, the first sheet size data D1 can be table data that defines paper sheet sizes corresponding to the second output values V2. The second sensor unit 72 (second output circuit 72*d*) has high accuracy and a resolution of approximately 16 to 24 bits. For example, a range of the second output value V2 can be defined in steps corresponding to 1 mm of the paper sheet. It may be defined in steps corresponding to 0.1 mm. The control unit 2 can detect (recognize) a size of the paper sheet in more detail than a conventional one. As described above with reference to FIG. 15, a variation (gradient) of the second output value V2 is constant with respect to a movement amount of the second conductive plate 82. The second output value V2 varies linearly to a movement amount of the second conductive plate 82. Therefore, the first sheet size data D1 may be data that defines a linear function of Z (sheet size)=a (gradient)×X (second output value V2)+b (intercept). In this case, the control unit 2 determines the sheet size by calculation using the linear function.

In addition, the control unit 2 recognizes a size of the set paper sheets in the conveying direction based on the second sheet size data D2 (stored in the storage unit 3) and the third output value V3 (Step #56). With Step #56, the detection of the set sheet size is finished. Then, this flow is finished (END). With reference to FIG. 20, the second sheet size data D2 is described. A magnitude of the third output value V3 corresponds to a position of the third conductive plate 83 (position of the rear end regulation cursor 65). Therefore, as illustrated in FIG. 20, the second sheet size data D2 can be table data that defines the paper sheet size corresponding to third the output value V3. The third sensor unit 73 (third output part 73*d*) also has a resolution of approximately 16 to 24 bits. Therefore, for example, a range of the third output value V3 can be defined in steps corresponding to 1 mm of the paper sheet. It may be defined in steps corresponding to 0.1 mm. The control unit 2 can detect (recognize) a size of the paper sheet in the conveying direction in more detail than a conventional one.

In addition, as described above with reference to FIG. 15, a variation (gradient) of the third output value V3 is also constant with respect to a movement amount of the third conductive plate 83. The third output value V3 varies linearly to a movement amount of the third conductive plate 83. Therefore, the second sheet size data D2 may be data that defines a linear function of Z (sheet size)=a (gradient)×Y (third output value V3)+b (intercept). In this case, the control unit 2 determines the sheet size in the conveying direction by calculation using the linear function.

In this way, the sheet feeding device 1 according to the embodiment includes the cassette 61, the first sensor unit 71, the first moving mechanism 9*a*, the storage unit 3, and the control unit 2. The cassette 61 includes the sheet placing plate 63 having the upper surface on which paper sheets are set. The cassette 61 is detachable and attachable. The first sensor unit 71 includes the first conductive plate 81 and the first coil circuit board L1 on which the coil pattern P1 is printed. The first sensor unit 71 applies a voltage to the first coil circuit board L1 so that a magnetic field is generated. The first sensor unit 71 outputs the first output value V1 corresponding to a position of the first conductive plate 81. The first moving mechanism 9*a* moves the first conductive plate 81 so that a facing area between the first coil circuit board L1 and the first conductive plate 81 is increased or decreased according to a remaining quantity of paper sheets in the cassette 61. The storage unit 3 stores the remaining quantity detection data A1 for determining a current remaining quantity of paper sheets corresponding to the first output value V1. The storage unit 3 stores the reference value A2 for determining whether or not the cassette 61 is attached. The control unit 2 recognizes a magnitude of the first output value V1. The first conductive plate 81 is disposed in the cassette 61. The first coil circuit board L1 is not disposed in the cassette 61. The first coil circuit board L1 is disposed at a position facing the first conductive plate 81 in a non-contact manner when the cassette 61 is attached. The control unit 2 determines the current remaining quantity of paper sheets based on the magnitude of the first output value V1 and the remaining quantity detection data A1. The control unit 2 determines whether or not the cassette 61 is attached based on the magnitude of the first output value V1 and the reference value A2.

In this way, the sensor for detecting the remaining quantity of paper sheets can also detect whether the cassette 61 is attached or detached. A dedicated sensor for detecting whether or not the cassette 61 is attached, which is disposed in a conventional structure, can be eliminated. Therefore, cost in manufacturing the sheet feeding device 1, and time and effort for developing the same can be reduced. In addition, when the cassette 61 is inserted strongly (vigorously), a dedicated sensor for detecting the attachment may be damaged. However, the first coil circuit board L1 and the first conductive plate 81 do not contact with each other. Even if the cassette 61 is inserted strongly, the sheet feeding device 1 according to the present disclosure does not cause a breakdown of the sensor. Therefore it is possible to provide the sheet feeding device 1 that is resistant to breakdown.

In addition, the first sensor unit 71 outputs the first output value V1 having a larger value as the distance between the first coil circuit board L1 and the first conductive plate 81 is smaller, and as the facing area between the first coil circuit board L1 and the first conductive plate 81 is larger. The control unit 2 determines that the cassette 61 is not attached when the first output value V1 is smaller than the reference value A2. The control unit 2 determines that the cassette 61 is attached when the first output value V1 is larger than or equal to the reference value A2. In this way, it is possible to correctly determine (detect) whether or not the cassette 61 is attached based on a magnitude relationship of the first output value V1.

In addition, the sheet feeding device 1 includes the sheet feed roller 62*a*, and the lifting mechanism 67. The sheet feed roller 62*a* is disposed above the sheet placing plate 63. The sheet feed roller 62*a* sends out paper sheets set on the sheet placing plate 63. The lifting mechanism 67 moves the sheet placing plate 63 upward and downward. When the cassette 61 is attached, the lifting mechanism 67 moves the sheet placing plate 63 upward until the sheet feed roller 62*a* contacts with the paper sheets on the sheet placing plate 63. The first moving mechanism 9*a* moves the first conductive plate 81 so that the facing area between the first coil circuit board L1 and the first conductive plate 81 is increased or decreased according to a height of the sheet placing plate 63. The lifting mechanism 67 sets the sheet placing plate 63 at the lower limit position when the cassette 61 is detached. The reference value A2 is determined based on the first output value V1 when the sheet placing plate 63 is at the lower limit position. In this way, when the cassette 61 is detached, the sheet placing plate 63 can be set at the lower limit position. An initial position of the sheet placing plate 63 when the cassette 61 is attached can be set at the lower limit position. The reference value A2 can be set based on the first output value V1 corresponding to an initial position of the sheet placing plate 63 when the cassette 61 is attached. Attachment or detachment of the cassette 61 can be correctly determined.

In addition, the lifting mechanism 67 includes the drive shaft 67*b*, the lifting member 67*c*, and the lifting motor 67*a*. The lifting member 67*c* is attached to the drive shaft 67*b*. The lifting member 67*c* lifts the sheet placing plate 63 to move upward. The lifting motor 67*a* rotates the drive shaft 67*b*. The first moving mechanism 9*a* includes the rotation plate 10. The rotation plate 10 is fixed to the drive shaft 67*b*. The rotation plate 10 changes its rotation angle along with a rotation angle of the drive shaft 67*b*. The first conductive plate 81 has a substantially triangular shape and is attached to the rotation plate 10. The first coil circuit board L1 is disposed at a position facing the rotation plate 10 when the cassette 61 is attached. As the sheet placing plate 63 moves upward, the rotation plate 10 moves the first conductive plate 81 to be close to the center of the first coil circuit board L1, viewing the first coil circuit board L1 and the first conductive plate 81 from front, and hence the facing area between the first coil circuit board L1 and the first conductive plate 81 is increased. In this way, the facing area between the first coil circuit board L1 and the first conductive plate 81 can be increased in proportion to an upward moving amount of the sheet placing plate 63. The facing area between the first coil circuit board L1 and the first conductive plate 81 can be decreased in proportion to a downward moving amount of the sheet placing plate 63. Therefore the first output value V1 can be changed according to a height of the sheet placing plate 63 (remaining quantity of paper sheets).

In addition, the cassette 61 includes the width regulation cursors 64*a*, the second moving mechanism 9*b*, and the second sensor unit 72. The width regulation cursors 64*a* regulate a position of the set paper sheets. The width regulation cursors 64*a* can move to slide in the direction perpendicular to the conveying direction. The second sensor unit 72 includes the second conductive plate 82 and the second coil circuit board L2. The coil pattern P2 is printed on the second coil circuit board L2. The second sensor unit 72 applies a voltage to the second coil circuit board L2 so that a magnetic field is generated. The second sensor unit 72 outputs the second output value V2 corresponding to a position of the second conductive plate 82. The second conductive plate 82 is disposed in the cassette 61. The second coil circuit board L2 is not disposed in the cassette 61. The second coil circuit board L2 is disposed at a position facing the second conductive plate 82 in a non-contact manner when the cassette 61 is attached. A movement range of the second conductive plate 82 is smaller than a length of the second coil circuit board L2 in the longitudinal direction. The second moving mechanism 9*b* moves the second conductive plate 82 in the longitudinal direction of the second coil circuit board L2 according to a position of the width regulation cursor 64*a*. The storage unit 3 stores the first sheet size data D1 for determining a size of paper sheets in the direction perpendicular to the conveying direction corresponding to a magnitude of the second output value V2. When determining that the cassette 61 is attached, the control unit 2 recognizes a size of the set paper sheets in the direction perpendicular to the conveying direction based on the magnitude of the second output value V2 and the first sheet size data D1.

In this way, by supplying current to the second coil circuit board L2, eddy current can be generated in the second conductive plate 82. An inductance of the second coil circuit board L2 has a value corresponding to a degree of magnetic coupling between the second coil circuit board L2 and the second conductive plate 82. A sheet size in the direction perpendicular to the conveying direction can be determined based on the second output value V2 having much higher definition (higher resolution) compared with a conventional method (a method using an optical sensor or a contact-type switch). Therefore a size of set paper sheets can be detected correctly with high accuracy. When using non-standard size paper sheets, it is not necessary to set a correct length of the paper sheets in the direction perpendicular to the conveying direction. Further, as the second coil circuit board L2 and the second conductive plate 82 do not contact with each other, there is no abrasion between them. Therefore there is little aging deterioration.

In addition, the cassette 61 includes the rear end regulation cursor 65, the third moving mechanism 9*c*, and the third sensor unit 73. The rear end regulation cursor 65 regulates a position of the set paper sheets. The rear end regulation cursor 65 can move to slide in the conveying direction. The third sensor unit 73 includes the third conductive plate 83 and the third coil circuit board L3. The coil pattern P3 is printed on the third coil circuit board L3. The third sensor unit 73 applies a voltage to the third coil circuit board L3 so that a magnetic field is generated. The third sensor unit 73 outputs the third output value V3 corresponding to a position of the third conductive plate 83. The third conductive plate 83 is disposed in the cassette 61. The third coil circuit board L3 is not disposed in the cassette 61. The third coil circuit board L3 is disposed at a position facing the third conductive plate 83 in a non-contact manner when the cassette 61 is attached. The third conductive plate 83 has a movement range smaller than a length of the third coil circuit board L3 in the longitudinal direction. The third moving mechanism 9*c* moves the third conductive plate 83 in the longitudinal direction of the third coil circuit board L3 according to a position of the rear end regulation cursor 65. The storage unit 3 stores the second sheet size data D2 for determining a paper sheet size in the conveying direction corresponding to a magnitude of the third output value V3. When determining that the cassette 61 is attached, the control unit 2 recognizes a size of the set paper sheets in the conveying direction based on a magnitude of the third output value V3 and the second sheet size data D2.

In this way, by supplying the third coil circuit board L3 with current, eddy current can be generated in the third conductive plate 83. An inductance of the third coil circuit board L3 has a value corresponding to a degree of magnetic coupling between the third coil circuit board L3 and the third conductive plate 83. A sheet size in the conveying direction can be determined based on the output value having much higher definition (higher resolution) compared with a conventional method (a method using an optical sensor or a contact-type switch). A size of set paper sheets can be correctly detected with high accuracy. When using non-standard size paper sheets, it is not necessary to set a sheet size. Further, the third coil circuit board L3 and the third conductive plate 83 also do not contact with each other, and hence there is no abrasion. Therefore there is little aging deterioration.

In addition, the image forming apparatus (multifunction peripheral 100) includes the sheet feeding device 1. As it includes the sheet feeding device 1 described above, cost in manufacturing the image forming apparatus, and time and effort for developing the same can be reduced. In addition, it is possible to provide the image forming apparatus including the sheet feeding device 1 that is resistant to breakdown. Although the embodiment of the present disclosure is described above, the present disclosure is not limited to this and can be variously modified for implementation without deviating from the spirit of the disclosure.

What is claimed is:

1. A sheet feeding device comparing:

a cassette including a sheet placing plate having an upper surface on which paper sheets are set, the cassette being detachable and attachable;

a first sensor unit including a first conductive plate and a first coil circuit board on which a coil pattern is printed, the first coil circuit board being applied with a voltage so that a magnetic field is generated, and so that the first sensor unit outputs a first output value corresponding to a position of the first conductive plate;

a first moving mechanism arranged to move the first conductive plate so that a facing area between the first coil circuit board and the first conductive plate is increased or decreased according to remaining quantity of paper sheets in the cassette;

a storage unit arranged to store remaining quantity detection data for determining current remaining quantity of paper sheets corresponding to the first output value, and a reference value for determining whether or not the cassette is attached; and a control unit arranged to recognize a magnitude of the first output value, wherein the first conductive plate is attached to the cassette, the first coil circuit board is disposed at a position facing the first conductive plate in a non-contact manner when the cassette is attached, but is not attached to the cassette, and the control unit determines the current remaining quantity of paper sheets based on the magnitude of the first output value and the remaining quantity detection data, and determines whether or not the cassette is attached based on the magnitude of the first output value and the reference value.

2. The sheet feeding device according to claim 1, wherein the first sensor unit outputs the first output value having a larger value as a distance between the first coil circuit board and the first conductive plate is smaller, and as the facing area between the first coil circuit board and the first conductive plate is larger, and the control unit determines that the cassette is not attached when the first output value is smaller than the reference value, and determines that the cassette is attached when the first output value is larger than or equal to the reference value.

3. The sheet feeding device according to claim 1, further comprising:

a sheet feed roller disposed above the sheet placing plate so as to send out paper sheets set on the sheet placing plate; and a lifting mechanism arranged to move the sheet placing plate upward and downward, and to move the sheet placing plate upward until the sheet feed roller contacts with the paper sheets on the sheet placing plate when the cassette is attached, wherein the first moving mechanism moves the first conductive plate so that the facing area between the first coil circuit board and the first conductive plate is increased or decreased according to a height of the sheet placing plate, the lifting mechanism sets the sheet placing plate at a lower limit position when the cassette is detached, and the reference value is determined based on the first output value when the sheet placing plate is at the lower limit position.

4. The sheet feeding device according to claim 3, wherein the lifting mechanism includes a drive shaft, a lifting member fixed to the drive shaft so as to lift the sheet placing plate to move upward, and a lifting motor arranged to rotate the drive shaft, the first moving mechanism includes a rotation plate fixed to the drive shaft so as to change its rotation angle according to a rotation angle of the drive shaft, the first conductive plate has a substantially triangular shape and is fixed to the rotation plate, the first coil circuit board is disposed at a position facing the rotation plate when the cassette is attached, and as the sheet placing plate moves upward, the rotation plate moves the first conductive plate to be close to the center of the first coil circuit board when viewing the first coil circuit board from front, so that the facing area between the first coil circuit board and the first conductive plate is increased.

5. The sheet feeding device according to claim 1, wherein the cassette includes width regulation cursors capable of moving to slide in a direction perpendicular to a conveying direction, so as to regulate a position of set paper sheets, a second moving mechanism, and a second sensor unit, the second sensor unit includes a second conductive plate and a second coil circuit board on which a coil pattern is printed, the second sensor unit applies a voltage to the second coil circuit board so that a magnetic field is generated, and outputs a second output value corresponding to a position of the second conductive plate, the second conductive plate is attached to the cassette, the second coil circuit board is not attached to the cassette, but is disposed at a position facing the second conductive plate in a non-contact manner when the cassette is attached, the second conductive plate has a movement range that is smaller than a length of the second coil circuit board in the longitudinal direction, the second moving mechanism moves the second conductive plate in the longitudinal direction of the second coil circuit board according to a position of the width regulation cursor, the storage unit stores first sheet size data for determining a paper sheet size in a direction perpendicular to the conveying direction corresponding to a magnitude of the second output value, and when determining that the cassette is attached, the control unit recognizes a size of set paper sheets in the direction perpendicular to the conveying direction based on the magnitude of the second output value and the first sheet size data.

6. The sheet feeding device according to claim 1, wherein the cassette includes a rear end regulation cursor capable of moving to slide in a conveying direction, so as to regulate a position of set paper sheets, a third moving mechanism, and a third sensor unit, the third sensor unit includes a third conductive plate and a third coil circuit board on which a coil pattern is printed, the third sensor unit applies a voltage to the third coil circuit board so that a magnetic field is generated, and outputs a third output value corresponding to a position of the third conductive plate, the third conductive plate is attached to the cassette, the third coil circuit board is not attached to the cassette, but is disposed at a position facing the third conductive plate in a non-contact manner when the cassette is attached, the third conductive plate has a movement range that is smaller than a length of the third coil circuit board in the longitudinal direction, the third moving mechanism moves the third conductive plate in the longitudinal direction of the third coil circuit board according to a position of the rear end regulation cursor, the storage unit stores second sheet size data for determining a paper sheet size in the conveying direction corresponding to a magnitude of the third output value, and when determining that the cassette is attached, the control unit recognizes a size of set paper sheets in the conveying direction based on the magnitude of the third output value and the second sheet size data.

7. The sheet feeding device according to claim 1, wherein the storage unit stores the remaining quantity detection data in which a no sheet value and a full sheet value are defined, the no sheet value is the first output value when the sheet placing plate is moved upward to the upper limit position in a state without paper sheets, the full sheet value is the first output value when the sheet placing plate is moved upward to the upper limit position in a state with full paper sheets, and the control unit determines the remaining quantity of paper sheets by dividing an absolute value of a difference between the recognized first output value and the no sheet value by an absolute value of a difference between the no sheet value and the full sheet value.

8. The sheet feeding device according to claim 1, wherein the reference value is a lower limit value that is the first output value when the sheet placing plate is at the lower limit position, or a value obtained by adding a predetermined margin value to the lower limit value.

9. The sheet feeding device according to claim 8, wherein the control unit determines a new value of the reference value based on the recognized first output value before the sheet placing plate moves upward when the cassette is attached, and updates the reference value to the new value.

10. An image forming apparatus comprising the sheet feeding device according to claim 1.

11. A method for controlling a sheet feeding device, comprising:

allowing a cassette to be detachable and attachable, the cassette including a sheet placing plate having an upper surface on which paper sheets are set;

disposing a first sensor unit including a first conductive plate and a first coil circuit board on which a coil pattern is printed, the first coil circuit board being applied with a voltage so that a magnetic field is generated, and so that the first sensor unit outputs a first output value corresponding to a position of the first conductive plate;

moving the first conductive plate so that a facing area between the first coil circuit board and the first conductive plate is increased or decreased according to remaining quantity of paper sheets in the cassette;

storing remaining quantity detection data for determining current remaining quantity of paper sheets corresponding to the first output value;

storing a reference value for determining whether or not the cassette is attached;

recognizing a magnitude of the first output value;

providing the first conductive plate to the cassette;

disposing the first coil circuit board at a position facing the first conductive plate in a non-contact manner when the cassette is attached without providing the first coil circuit board to the cassette;

determining the current remaining quantity of paper sheets based on the magnitude of the first output value and the remaining quantity detection data; and determining whether or not the cassette is attached based on the magnitude of the first output value and the reference value.

* * * * *